US011318345B2

(12) United States Patent
Bassoo

(10) Patent No.: US 11,318,345 B2
(45) Date of Patent: May 3, 2022

(54) SAND PIT TRAINING BAG

(71) Applicant: Naipaul Bassoo, North York (CA)

(72) Inventor: Naipaul Bassoo, North York (CA)

(73) Assignee: Naipaul Bassoo, North York (CA)

( * ) Notice: Subject to any disclaimer, the term of this patent is extended or adjusted under 35 U.S.C. 154(b) by 231 days.

(21) Appl. No.: 16/656,840

(22) Filed: Oct. 18, 2019

(65) Prior Publication Data

US 2021/0113883 A1 Apr. 22, 2021
US 2021/0260433 A9 Aug. 26, 2021

Related U.S. Application Data

(63) Continuation-in-part of application No. 15/983,505, filed on May 18, 2018, now Pat. No. 10,561,886.

(51) Int. Cl.
*A63B 21/00* (2006.01)
*A63B 71/00* (2006.01)
(Continued)

(52) U.S. Cl.
CPC ..... *A63B 21/4033* (2015.10); *A63B 21/0603* (2013.01); *A63B 21/169* (2015.10);
(Continued)

(58) Field of Classification Search
CPC ..... A63B 6/00; A63B 21/0552; A63B 21/0555; A63B 21/0602; A63B 21/0603; A63B 21/0605; A63B 21/065; A63B 21/169; A63B 21/4007; A63B 21/4033; A63B 21/4035; A63B 21/4037; A63B 23/047; A63B 69/0028; A63B 71/0036; A63B 71/0054; A63B 71/03; A63B 2071/0694; A63B 2208/12; A63B 2209/10; A63B 2210/50; A63B 2214/00; A63B 2225/09; A63B 21/093; A63B 21/60; A63B 21/68; A63B 21/682; A63B 21/685; A63B 21/687; A45C 3/00; A45C 3/02; A45C 7/0095; A45C 9/00; A45C 13/02; A45F 3/04; A45F 4/02
See application file for complete search history.

(56) References Cited

U.S. PATENT DOCUMENTS 2,904,337 A * 9/1959 Canning ..... A63B 69/345 473/444
6,149,555 A * 11/2000 Kinback ..... A63B 21/06 383/10
(Continued)

*Primary Examiner* — Joshua Lee

(57) ABSTRACT

A sand training bag for sand and/or mineral training in an open and closed configuration. The sand pit training bags includes a sand pit training bag configuration comprising at least one fastener and at least one overlaying fabric around the perimeter to open flat on a surface. The sand training bag includes attachable wall structure, wherein the surface attachable wall structure is configured with a sand pit training bag in an open configuration visible relative to a sand or mineral pit held by one or more fasteners. The sand training bag includes a single sand pit training bag, wherein the single sand pit training bag is convertible to a single sand pit with at least one attachable perimeter wall around the perimeter of the open sand or mineral receiving surface configuration, wherein a top cover is configured to be viewed as a sand or mineral pit closed configuration.

6 Claims, 20 Drawing Sheets

(51) Int. Cl.
*A63B 21/16* (2006.01)
*A63B 21/06* (2006.01)
*A63B 69/00* (2006.01)

(52) U.S. Cl.
CPC ..... *A63B 21/4035* (2015.10); *A63B 71/0036* (2013.01); *A63B 69/0028* (2013.01); *A63B 2209/10* (2013.01); *A63B 2210/50* (2013.01); *A63B 2225/09* (2013.01); *A63B 2225/685* (2013.01); *A63B 2225/687* (2013.01)

(56) References Cited

U.S. PATENT DOCUMENTS

| | | | | |
|---|---|---|---|---|
| 10,149,997 | B1 * | 12/2018 | Henniger | A63B 21/0603 |
| 10,343,009 | B2 * | 7/2019 | Peyton | A63B 21/072 |
| 10,561,885 | B1 * | 2/2020 | Lewis, Jr. | A63B 21/0603 |
| 2007/0049469 | A1 * | 3/2007 | Brown | A45C 3/00 482/93 |
| 2010/0048363 | A1 * | 2/2010 | Gilberti | A63B 21/065 482/105 |
| 2011/0012309 | A1 * | 1/2011 | Schreff | A63B 41/02 273/407 |
| 2013/0157815 | A1 * | 6/2013 | Reynolds | A63B 21/072 482/93 |
| 2015/0051053 | A1 * | 2/2015 | Conen | A63B 21/075 482/108 |
| 2015/0174466 | A1 * | 6/2015 | Folland | A45C 5/00 206/315.1 |
| 2016/0129292 | A1 * | 5/2016 | Stroup | A63B 21/00065 482/93 |
| 2018/0333603 | A1 * | 11/2018 | Peyton | A63B 21/0602 |

* cited by examiner

SAND PIT TRAINING BAG

CROSS REFERENCE TO RELATED APPLICATIONS

This application claims benefit under 35 U.S.C. 120, as a continuation in part of U.S. application Ser. No. 15/983,505, filed May 18 2018, now U.S. Pat. No. 10,561,886 B2.

FIELD

The present disclosure relates generally to training bags, multi-functional bags and specifically to training bags for use in sand training in an open configuration and which can be joined together with or without compartments to create an expansive sand pit.

BACKGROUND

Sand training involves performing one or more of a variety of exercises or activities on a sand and mineral surface. A sand and minerals surface provides the benefit of being low impact and can be used for a variety of exercises and/or activities. Sand and/or mineral training can utilize a low impact surface which will heal and strengthening muscles in the lower extremity such as; gluteal maximus, medium and minimums, iliotibial band, hip flexor, ACL, MLC, meniscus, quadriceps, hamstring, tibialis/fibrosis, achilleas from fractures, tears or strains or ruptures.

The user of a sand surface may perform an activity during which the sand acts as a light resistance to movements, such as dry squats, single leg deadlifts or Romanian deadlift, basic jumps, medial or lateral acceleration, pronation, supination, dorsiflexion and plantarflexion of the ankle. A user can incorporate training techniques into sand training exercises or activities, for example as a user progresses from a specific lower body extremity exercise, such as those listed above, the user can incorporate plyometric training, in some instances where there is approval from a medical professional. For a desired increase in heart rate for cardiovascular purposes or for other reasons, a user using a sand surface may require or desire an expansive area in which to walk, run, jump or sprint.

Sand and/or mineral training can also be used to simulate other surfaces. For example, users interested in surfing can use sand as an acting wave, as the surface is unstable, to assist them in working on balance in multiple directions. Also, a beach volleyball team can practice and play games inside a sand pit, indoors and/or outdoors.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

In an embodiment of the present invention, a sand pit training bag for sand training is provided, comprising a set of bag walls including a training surface wall and a perimeter wall, wherein the sand pit training bag is transitional between a closed bag configuration. A set of attachable walls defines a bag chamber to an open sand pit configuration, in which the set of attachable bag walls forms a mineral receiving surface forming a floor of the sand pit and at least one perimeter wall forming a perimeter side wall of the sand pit. The sand pit can be provided to receive and hold a quantity of sand and minerals.

In the instance where there can be an unlimited quantity of sand or an undeterminable amount of sand and/or minerals, the user can alternatively add additional walls, side by side, and/or stacked on top each other that are attachable with releasable fasteners such as hook-and-loop and/or zipper. For example, releasable fasteners can be provided in all corners, for forming a sand pit, depending on the number of bags connected. The user has an option to connect the sand pit to an additional sand pit, from either side, by way of a releasable fastener such as a hook-and-loop device, a zipper, or another fastening device that can allow a user to create a sand pit having a theoretically unlimited perimeter. A compressed surface cover can be attached to the mineral receiving surface for additional cushioning when physical activities are performed in the sand pit.

These and other features, aspects and advantages of the present invention will become better understood with reference to the following drawings, description and claims.

BRIEF DESCRIPTIONS OF THE DRAWINGS/FIGURES

The principles of the invention may better be understood with reference to the accompanying figures provided by way of illustration of an exemplary embodiment, or embodiments, incorporating principles and aspects of the present invention, and in which.

Figure 1:
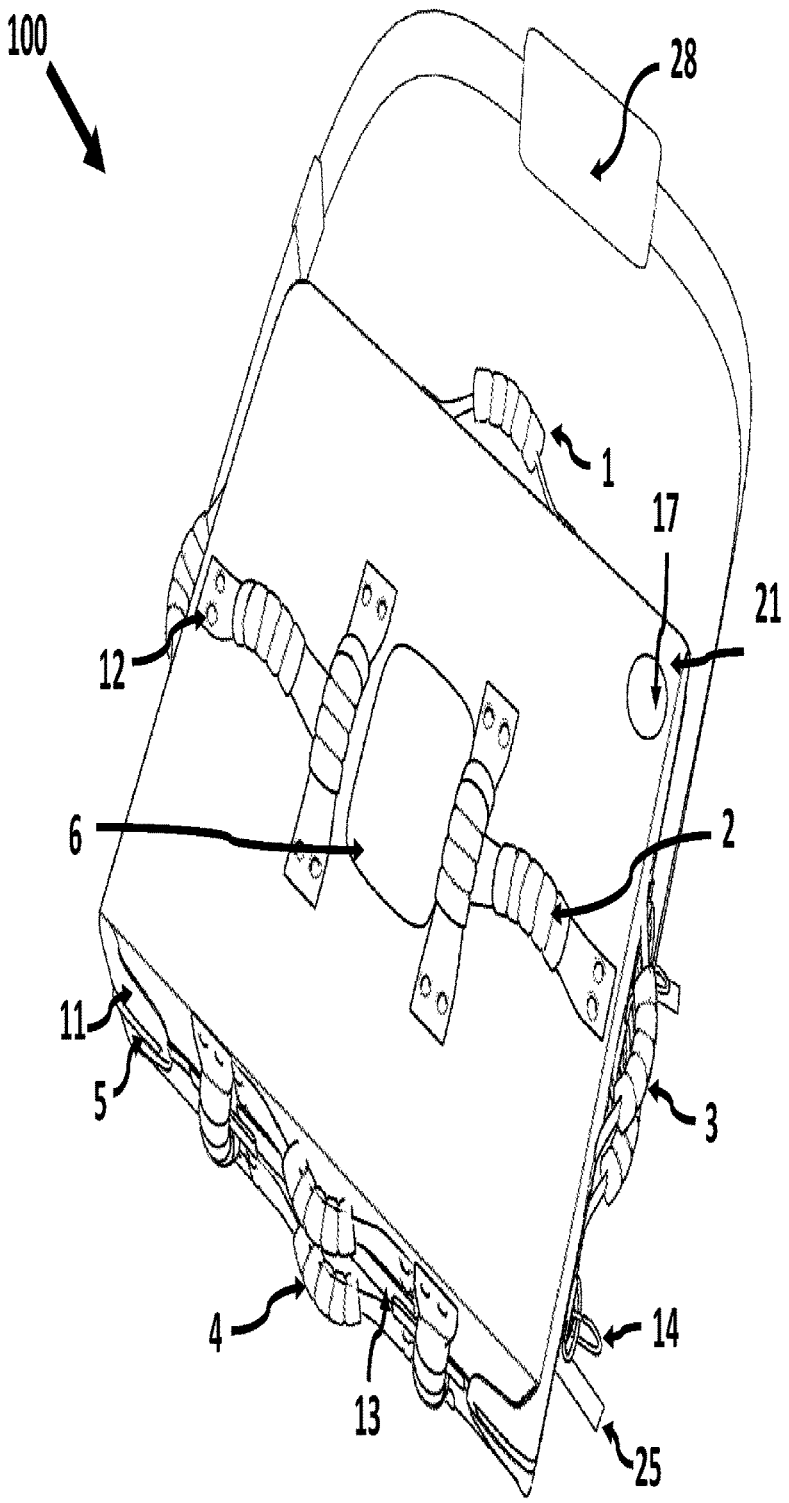
FIG. 1 is a top elevation perspective view of the sand pit training bag in a closed configuration with a shoulder strap attached to the loops, in accordance with an example.
Figure 2:
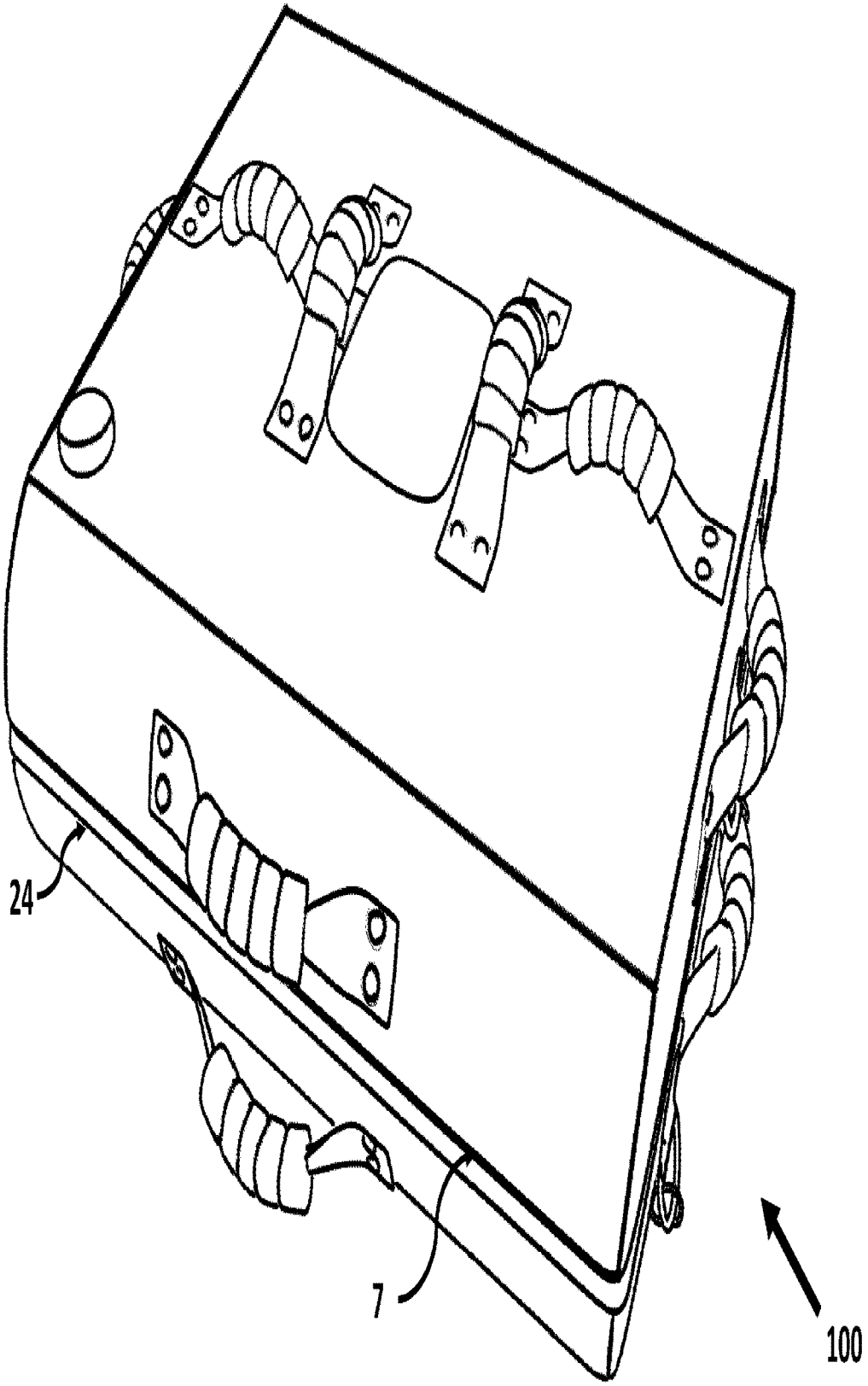
FIG. 2 is a top elevation perspective view of the sand pit training bag in a closed configuration, in accordance with an example.
Figure 3:
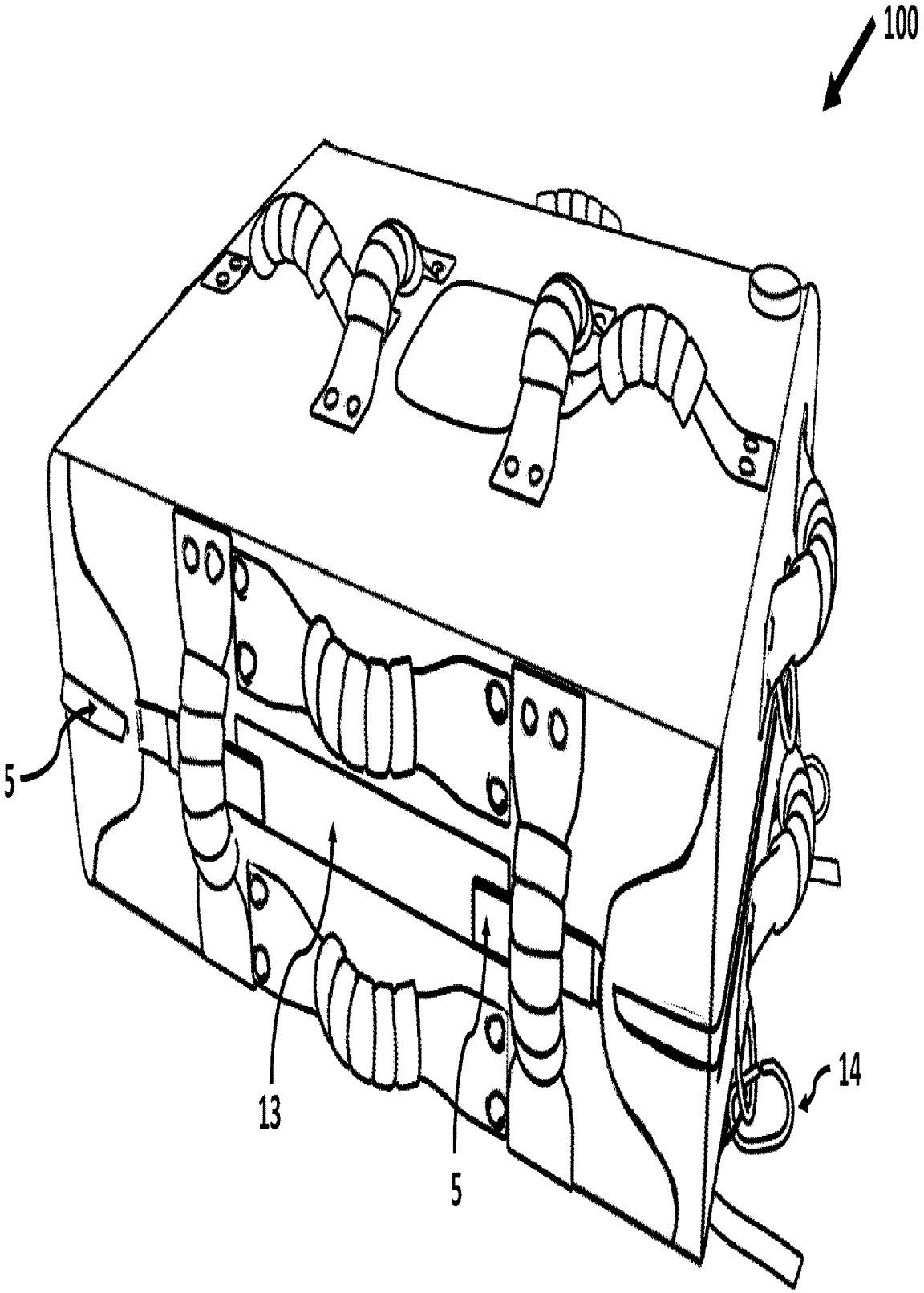
FIG. 3 is a bottom perspective view of the sand pit training bag in a closed configuration, in accordance with an example.
Figure 4:
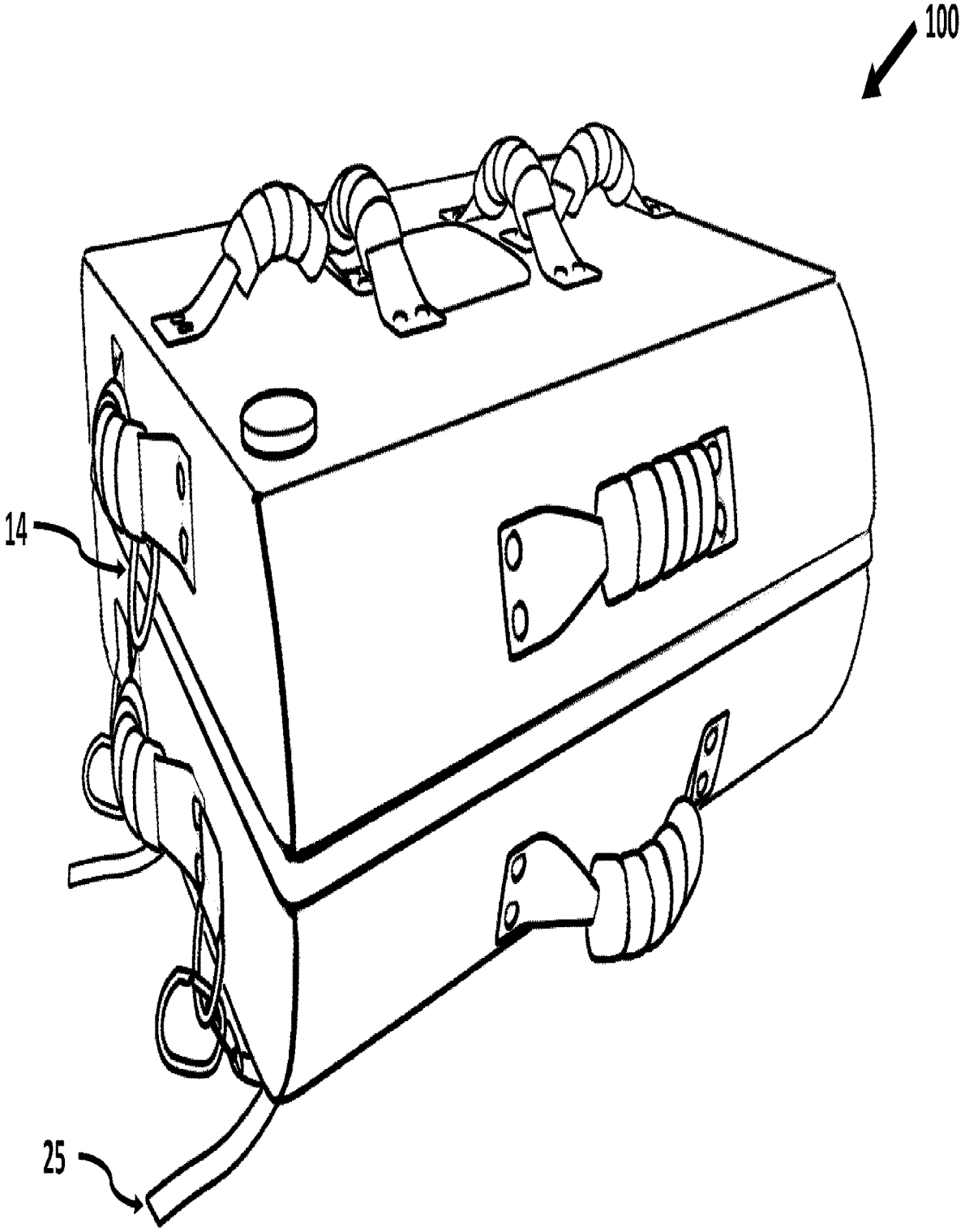
FIG. 4 is a top elevation perspective view of the sand pit training bag in a closed configuration with a backpack and one or more shoulder straps attached to the loops, in accordance with an example.

The following descriptions disclose one or more embodiments or combinations of embodiments describing elements of the sand pit training bag 100, sand pit 101 and sand pit with a top cover 102.

DETAILED DESCRIPTION

The description that follows, and the embodiments described therein, are provided by way of illustration of an example, or examples, of particular embodiments of the principles of the present invention. The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Reference will now be made in detail to selected embodiments of the present disclosure in conjunction with the accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, ranking, quantity, or importance, but rather are used to distinguish one element from another. Further, the terms "a" and "an" herein do not denote a limitation of quantity, but rather denote the presence of at least one of the referenced items.

In the following discussion we will explain how the present invention will work, and we will further explain all the invention parts and the function of every part, also we will explain the method to use the present invention.

The present disclosure describes a sand pit training bag 100, wherein the training bag is depicted in a closed configuration. The sand pit training bag 100 can be opened for use as a sand pit 101, to provide a mineral receiving surface 10 for sand and/or mineral training. The sand pit 101 may be provided with a top cover 102 for prevention of outside materials from entering the enclosure.

In some embodiments, a sand pit training bag 100 is reconfigurable for use with additional sand pit training bags 100, such that one or more of the additional sand pit training bags 100 can be joined together by at least one hook and loop fastener 7 to form an expanded mineral receiving surface 10 as depicted in FIGS. 11-18. Each of the additional sand pit training bags 100 can be joined together by one or more additional securing devices selected from the group of a zipper, a hook and loop fastener, buttons, Velcro 19, Velcro-held zipper covers 24 or other equivalent securing devices.

Figure 6:
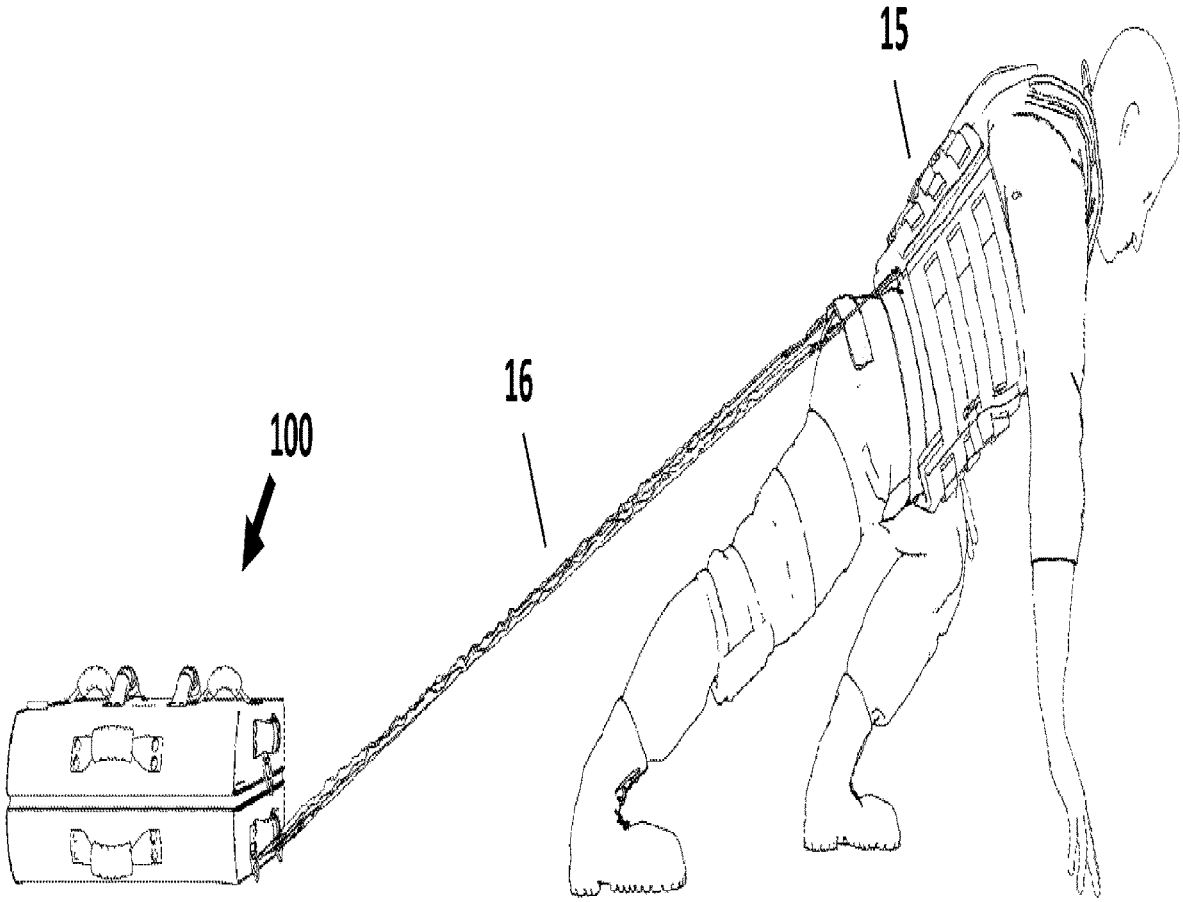
FIG. 6 is a user using a body harness dragging the sand pit training bag in a closed configuration, in accordance with an example.

In some embodiments, the sand pit training bag 100 can also incorporate at least one grip and other features such as at least one loop 14 for connecting accessories such as a body harness 15, and a shoulder strap 28. The harness 15 and shoulder strap 28 attachment can be one or more other attachments configured to be used in a variety of other exercises, such as, but not limiting to be lifted and/or dragged as depicted in FIG. 6. The act of dragging can be formed with a joining connection strap 16 removably connected to a body harness 15. The body harness 15 and the joining connection strap 16 are connected to the sand pit training bag 100, and further configured to allow a user to pull the sand pit training bag 100 a predetermined distance.

In a closed configuration 100, the sand pit training bag 100 defines an interior chamber, configured to hold personal items, exercise equipment and/or other items the user may wish to carry.

In a sand pit configuration 101, as shown in FIGS. 11-18, the sand pit training bag 100 defines a mineral receiving surface 10 for receiving and containing one or more layers of sand and/or minerals upon which physical activities can be performed.

In a sand pit configuration 101, the sand pit training bag 100 forms a mineral receiving surface 10 for exercises and/or activities.

The sand pit training bag 100 is a portable multi-purpose piece of equipment, which can alternatively be viewed as a slam bag, used as a pull sled with a body harness 15 sand pit 101, or used as substitution for free weights, kettlebell and a general bag.

In the embodiment depicted, the sand pit training bag 100 includes one or more grips 1-4 around the perimeter of the sand pit training bag 100. At least one grip 1-4 can be secured to an external surface of the sand pit training bag 100, with at least one rivet 12 and/or suitable reinforcements on one or more grips 1-4, around the perimeter of the grip 1-4, securing at least one grip 1-4 to the sand pit training bag 100 in a closed configuration shown in FIGS. 1-4.

In some embodiments, the grips 1-4 can be constructed out of seat belt webbing with compressed fabric such as foam and/or suitable materials for grip comfort.

Although the aforementioned range is considered the preferred embodiment, the size of the grips 1-4 can comprise of an endless amount of sizes and ranges, that are suitable to serve the purpose of this disclosure. The grips 1-4 can be as large, or as small as needed to serve the intended purpose In some embodiments, at least one zipper and/or suitable securable fasteners 7 around the entire sand pit training bag 100 bag can be covered by one or more hook and loop releasable fasteners 7 measured at least 2 inches, configured to prevent possible leakage of sand and/or minerals, in the closed configuration.

Many rehabilitation exercises, following injuries such as sports injuries, benefit from the performance of the exercises on, such as the mineral receiving surface 10 when covered with at least one layer of sand and/or minerals. When standing in one or more layers of sand and minerals, the user can improve on lower body strengthening and healing. Some examples are proprioceptive training, ankle strengthening, stabilization in the lower limbs.

Overhead and back squats, deadlifts, lunges, bicep curls, and triceps overhead extension are a few strength training exercises that can involve a sand pit training bag 100 according to some embodiments.

In some embodiments the sand pit training bag 100 can contain features to allow the sand pit training bag 100 to be used in a variety of exercises in addition to sand training exercises. These exercises can be structured in such a way in order to seize at least one grip 1-4 carrying the sand pit training bag 100 in a closed configuration and to allow the sand pit training bag 100 to be used as a weight for resistance training. Some resistance training exercises, such as Olympic lifting, involve power explosive movements. For such exercises, the sand pit training bag 100, such as in a closed configuration and when weighted down with a predetermined quantity of sand fillers 32 and/or other weighted objects, can be substituted for a barbell. This may reduce injury rates for beginners, considering the sand pit training bag 100 can be less likely to cause hyperextension to the wrist, due to the flexibility and the grip comfort of the grips 1-4. Alternatively, the sand pit training bag 100 can be configured with a wrist strap 23 in order to ensure an even more flexible and comfortable grip based on various training techniques.

When used to provide a mineral receiving surface 10 covered with one or more layers of sand and/or minerals, for exercises and/or activities, the sand pit training bag 100 can be beneficial as an unstable, low impact surface, which can be particularly useful for indoor when not accessible. For example, an unstable and low impact mineral receiving surface 10 can be beneficial physical and/or leisure activities.

The transition from the sand pit training bag 100 to the sand pit 101 in an open configuration, in which at least one layer of sand and/or minerals is received, the sand pit 101 can be used for a variety of activities including speed and agility drills, plyometrics and/or other relations to physical activities.

Another function for the sand pit 101, is for physical rehabilitation of upper and lower extremity injuries. The sand pit 101 can form one or more layers of sand and/or minerals in the mineral receiving surface 10; a user can then use one or more layers of sand and/or minerals distributed around the mineral receiving surface 10 for exercises, including exercises of injured wrists for minimal resistance training as a progression or in the rehabilitation of golfer's elbow (medial epicondyle) or tennis elbow (lateral epicondyle) or similar conditions. A common rehabilitation exercise is grasping and releasing the loose quantity of sand and/or minerals, strengthening the flexor digitorum, profundus, flexor pollicis longus and pronator quadatus. Additionally, salt and water can be used to increase the blood flow in the limb, also rejuvenating the skin.

The maximum weight the sand pit training bag 100 can support depends on the size of the sand pit training bag 100 along with the fabrics and materials when constructed. For example, it may be convenient to retail the sand pit training bag 100 in a number of standard sizes designed to hold predetermined weights.

In an exemplary embodiment, the sand pit training bag 100, with no added weight from sand fillers 32 or similar fillers, is at least half a pound. The user can conveniently increase or decrease the weight of the sand pit training bag 100 by adding or removing sand fillers 32 and/or weighted objects to the enclosure of the sand pit training bag 100.

It is to be understood sand and/or minerals are not limited to the amount of weight inside of the sand fillers 32 and can be liquids and/or dense minerals due to the coating of polyvinyl chloride and/or polyurethane fabric.

In some embodiments, the sand pit training bag 100 may be manufactured with a mixture of canvas and/or nylon, polyester with different coating such as polyvinyl chloride and/or polyurethane fabric for transparent proof.

In some embodiments, the interior of the sand pit training bag 100 is combined with the exterior canvas and/or nylon and/or polyester. This invention has one or more layers of fabric due to the functionalities, durability for long lasting. At least one attachable perimeter walls 29 will also be canvas, and/or nylon and/or polyester with a coating of polyvinyl chloride and/or polyurethane fabric. This invention can also be configured to support other minerals, such as bleach to cleanse the sand and/or minerals, not limiting to similar liquids.

The sand pit training bag 100 can include one or more grip 1-4 the interior and exterior of the sand pit training bag 100 for a wide variety of physical activities and/or to be occupied as a bag.

In some embodiments, the sand pit training bag 100 is designed to be lifted overhead, such as having at least one grip 1-4 around the dimension, allowing a user to easily grasp to hoist the sand pit training bag 100 overhead as in a weight lifting exercise.

In some embodiments, the sand pit training bag 100 can also, or alternatively, include at least one grip 1-4 to allow the bag to be carried as a hand bag.

In some embodiments, the sand pit training bag 100 can be made of a soft durable material such as canvas, nylon, polyester, leather or similar material which, in some embodiments, will not substantially discomfort a user holding the bag. Although, in some embodiments, the grip 1-4 of the sand pit training bag 100 and sand pit 101 can be formed of a material other than the material forming the attachable perimeter walls 29 of the sand pit training bag 100 such as a stiffer, denser, or more durable material.

The sand pit training bag 100 is designed as a convenient bag which can be converted from a sand pit training bag 100 to a sand pit 101, and in some embodiments the sand pit training bag 100 is provided as a multipurpose tool for physical and rehabilitation needs and for general exercises.

Closed Bag Configuration

Attachable perimeter wall 29 panels can be formed of a variety of durable, liquid proof materials and fabrics such as canvas or seat belt webbing in some embodiments, and can be impermeable to water, oil and other liquids in some embodiments.

To use the sand pit 101, the user can open the sand pit training bag 100 by releasing the surface fastener component 13 and/or hook and loop releasable fastener 7, opening the sand pit training bag 100 partially or fully on a surface to form a mineral receiving surface 10. In order to open, carry, or further support the sand pit training bag's 100 weight, the sand pit training bag 100 can be configured with one or more grips 1-4, on one or more sides of sand pit training pit bag 100. The sand pit training bag 100, can be configured with one or more face and rear side grip 2, right and left side grip 3, and bottom grip 4.

Attachable perimeter walls 29 can be provided and attached to the mineral receiving surface 10 by a hook and loop releasable fastener 7. One side of the hook and loop releasable fastener 7 can be configured to be affixed around the perimeter of the sand pit training bag 100 in an open configuration, specifically around the mineral receiving surface 10, and the bottom of at least one attachable perimeter wall 29 can be placed on the opposite side, effectively attaching the two together.

One or more attachable perimeter wall 29 and stacked perimeter wall 34 can be an opening made of hook and loop releasable fastener 7, to add or remove the materials inside of the attachable perimeter wall 29 and stacked perimeter wall 34 structure. For example, a user can choose to use a wood surface inside of a wall structure and another may choose to use a cardboard paper. This allows the user to choose the density of the wall structure. When retailed, the wall structure can come with a wide variety of materials, such as metal plates, steel, wood and/or polyvinyl chloride board.

Figure 13:
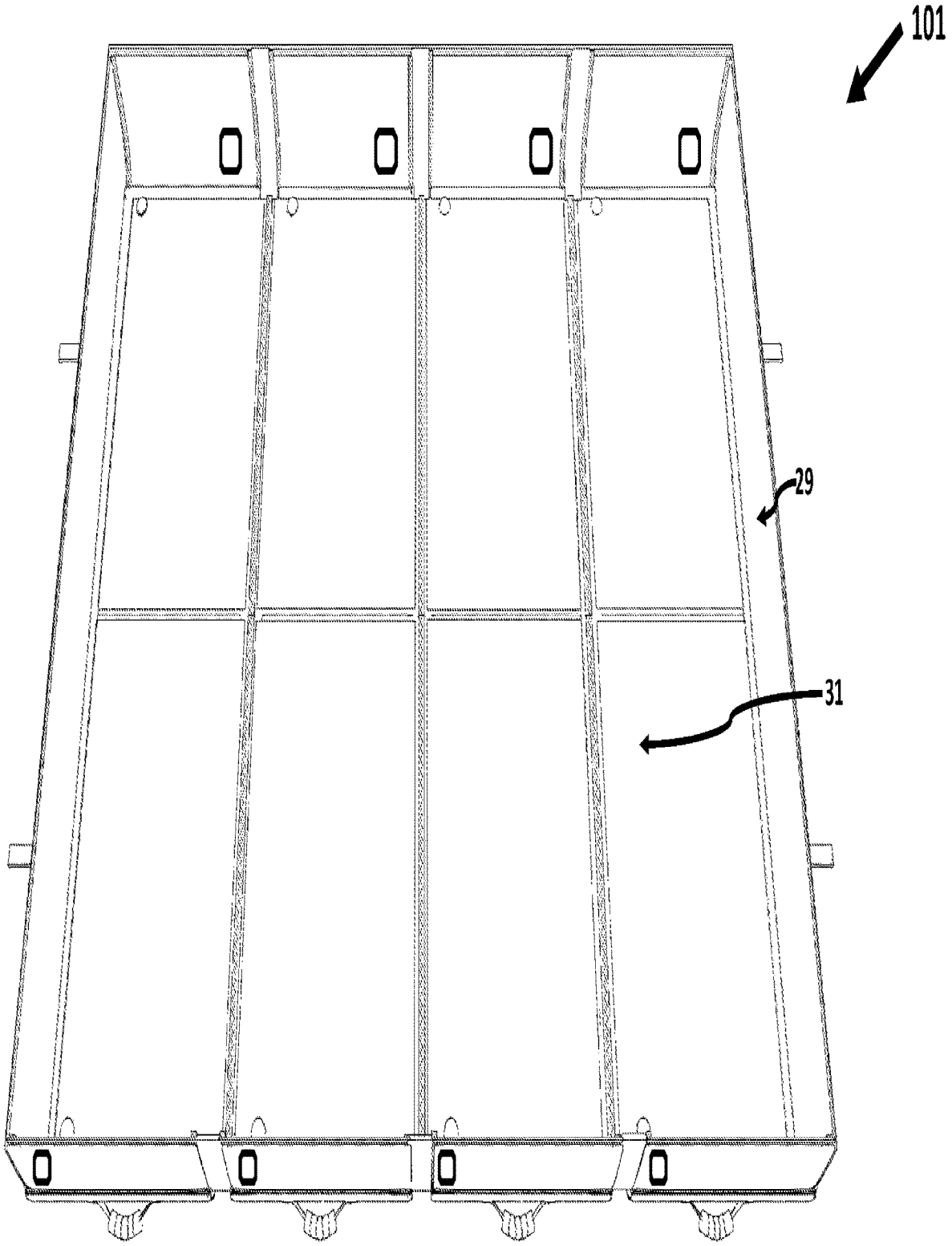
FIG. 13 is a top elevated perspective view of eight attached sand pit training bags with attachable perimeter walls and a compressed surface cover sizing for a single sand pit training bag in an open configuration, in accordance with an example.
Figure 14:
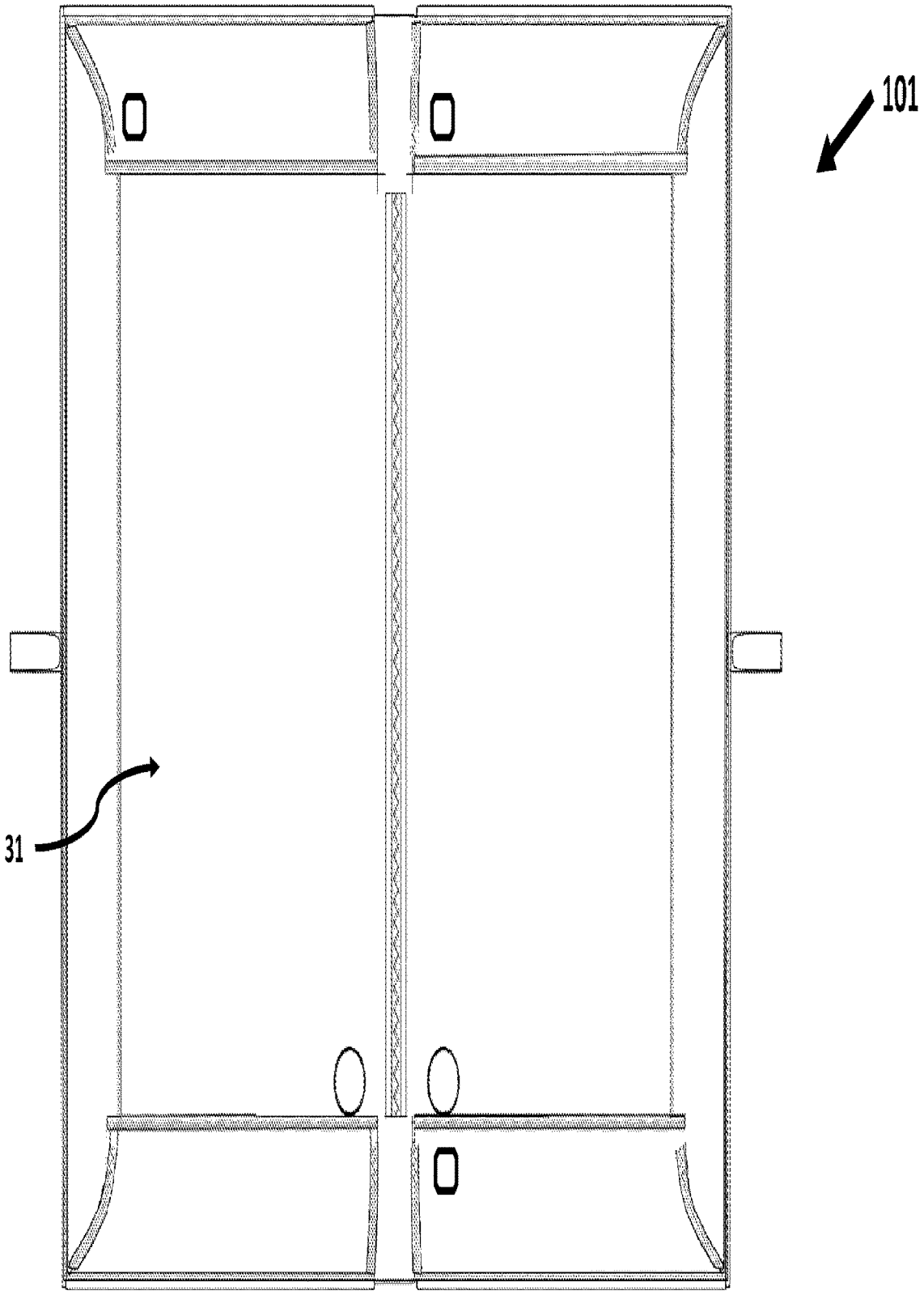
FIG. 14 is a top elevated perspective view of two eight attached sand pit training bags with attachable perimeter walls and a compressed surface cover sizing for two eight sand pit training bags in an open configuration, in accordance with an example.
Figure 15:
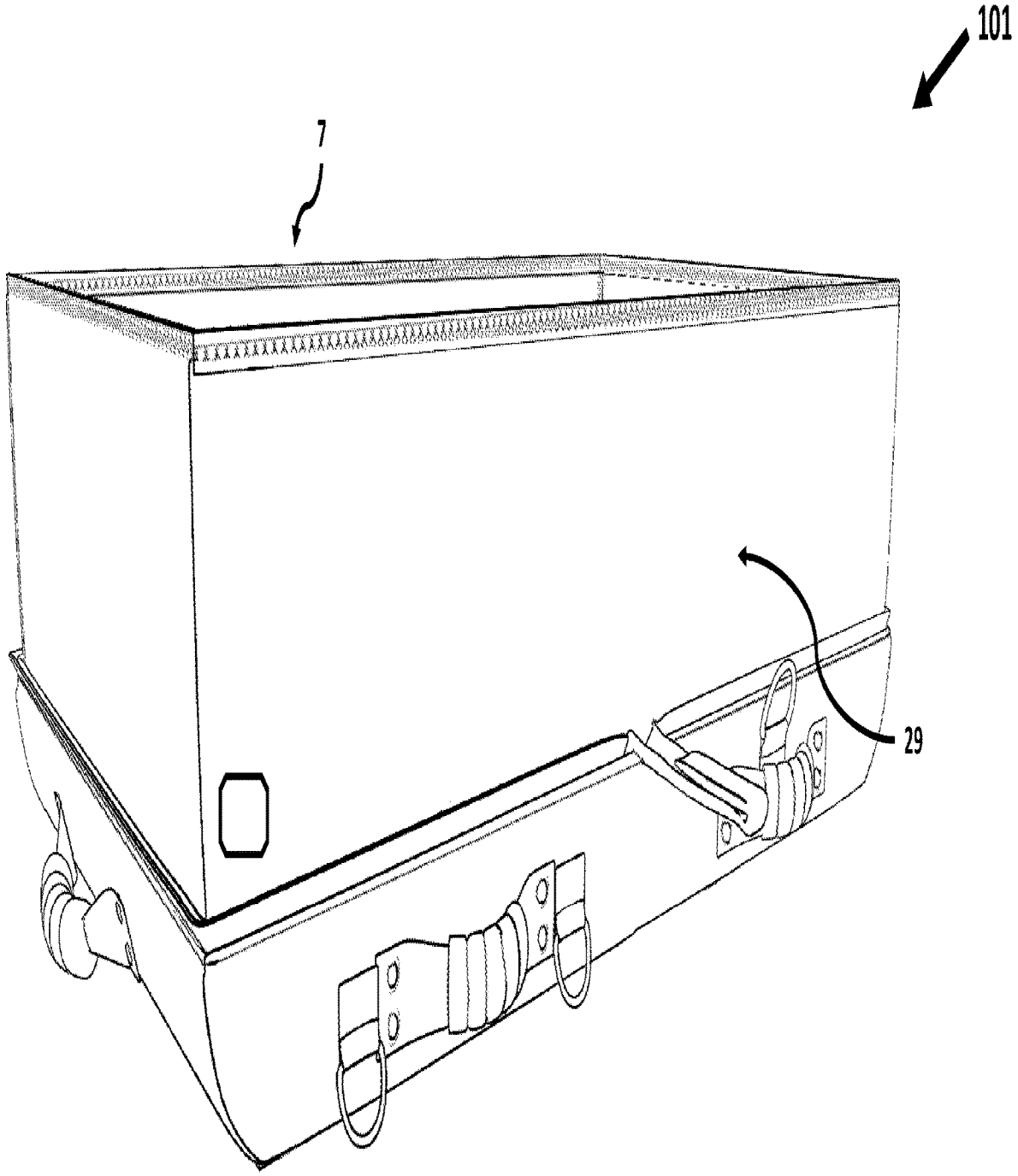
FIG. 15 is a side perspective view of two attached sand pit training bags with attachable perimeter walls.

FIG. 13-15 illustrates a compressed surface cover 31 covering the entire mineral receiving surface 10. FIG. 13 illustrates each compressed surface cover 31 can fit eight sand pit 101. FIG. 14 illustrates the compressed surface cover 31 can size to fit two sand pit training bag 100 to form an expansion sand pit 101. The compressed surface cover was designed to fit one sand pit training bag 100, illustrated on FIG. 16. Another option is to retail compressed surface cover 31 sizing to fit two sand pit training bags 100. This provides convenient options for the user to purchase a single sand pit training bag 100 or to have an expansion of the sand pit 101. To expand to more than two sand pit training bag 100, the compressed surface cover 31 can be provided with a hook and look releasable fastener 7 underneath to attach one or more attachable perimeter wall 29. Additionally, the user can also attach on the compressed surface cover 31 to the wall segment wherein connects one or more sand pit training bags 100 together. The user can then pour sand and/or minerals with or without the compressed surface cover 31 into the sand pit 101 to form a mineral receiving surface 10, such as pouring sand and minerals from the sand fillers 32 or similar fillers.

This can give the user three options to use the base of the sand pit 101, wherein, a wall segment at attached in between two sand pit training bags 100 and specifically on the mineral receiving surface 10, compressed surface cover 31 over the mineral receiving surface 10 wall segment or to have the compressed surface cover 31 as a main structure base without the sand pit training bag 100 underneath.

In one embodiment, without the sand pit training bag underneath, the pit training bag can be effectively utilized to maximize the training area, and to increase space for a user to be able to perform a larger variety of different exercises and activities. Additionally, there can be a decrease in the amount of sand and minerals that are needed to be used as sand fillers, or similar fillers in order to solidify the main structure base. Due to this, various combination or amounts of sand fillers can be implemented into the main structure base in order to increase the density, thickness, or hardness, or decrease accordingly, to suit the instruction, the activity, or the user's needs.

In some embodiments, any combination of perimeter walls can be installed to suit, in order to create a plurality of segments, and training area. With a multitude of training areas, the amount of sand pit training bags, and the training areas can be infinite, if not endless. In one instance, the compressed surface cover 31 can size to fit two or more sand pit training bags 100 to form numerous combinations of expansion sand pits 101.

In some embodiments, the mineral receiving surface 10 can include one or more layers of fabric to improve durability and/or other desirable qualities. The mineral receiving surface 10 can first be made of at least one layer of vinyl and foam to provide padding such as to provide a low impact surface even if the layer of sand and/or minerals added by the user is inadequately covering the mineral receiving surface 10. The coating around the mineral receiving surface 10 can include polyvinyl chloride and/or polyurethane to allow transparent liquids and/or bleach without damaging the mineral receiving surface 10.

The mineral receiving surface 10 can also be chosen to provide enough surface friction to keep the sand from flowing freely across the mineral receiving surface 10.

The mineral receiving surface 10 is designed to be used with a variety of activities including explosive physical movements, such as Plyometrics (jumping, sprinting, accelerating, lateral hops). However, most speed training and rehabilitation exercises are low impact movements, and would not cause significant damage to the sand pit training bag 100. As sand and/or minerals can distribute around the enclosure from repetitive exercises, a compressed surface cover 31 is provided to prevent impact to the user's limbs.

In some embodiments, one level of attachable perimeter walls 29 is at least 5 inches to prevent any leakage of sand and/or minerals while performing activities.

Figure 16:
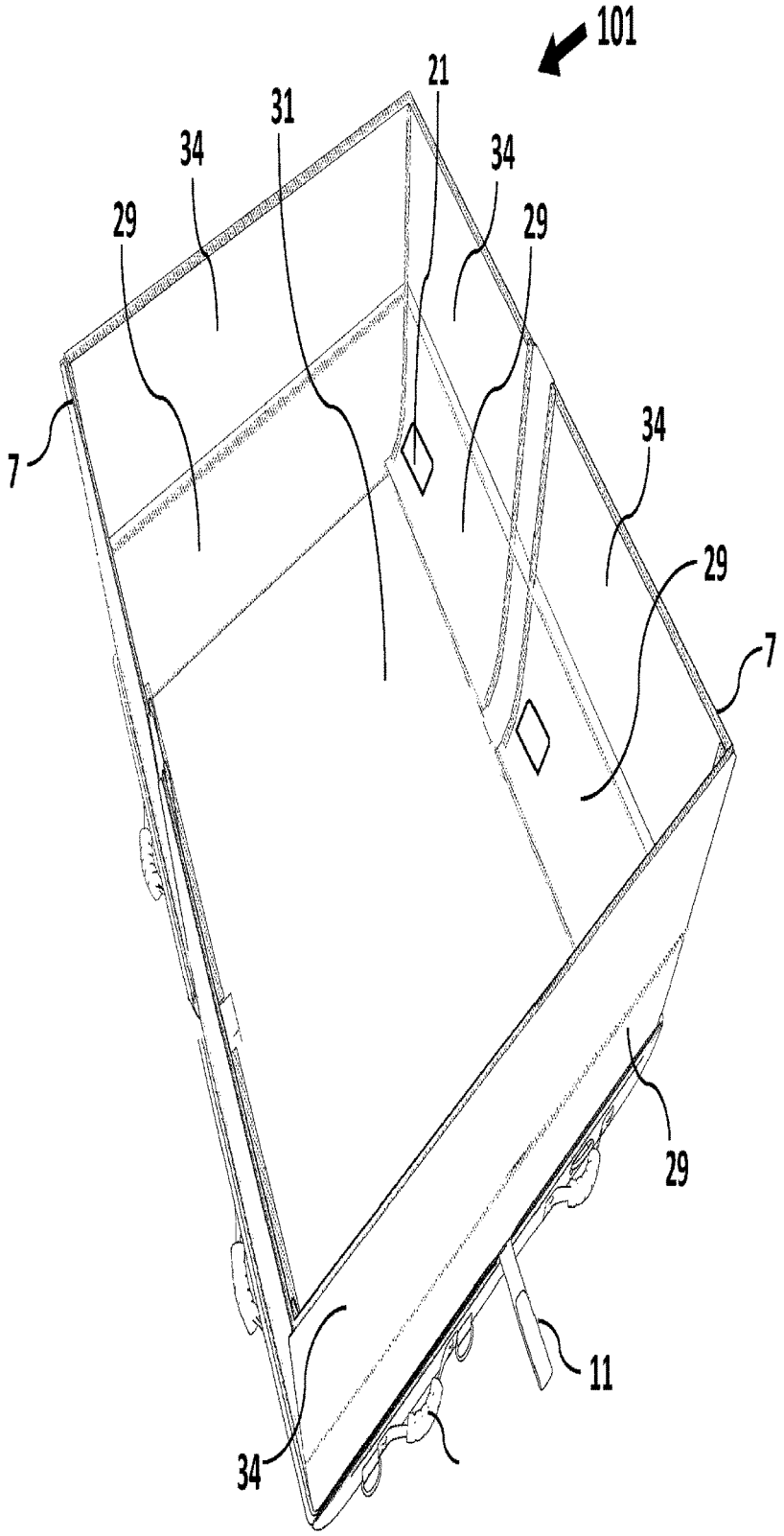
FIG. 16 is a perspective view of two attached sand pit training bags with two attachable perimeter walls stacked on top of each other, in accordance with an example.

If the user would like to increase the layers of sand and/or minerals and/or transparent liquids, at least one attachable perimeter wall 29 such as a stacked perimeter wall 34 can be attached via hook and loop releasable fastener 7 and/or other connectors on top of each other to prevent any leakage as illustrated in FIG. 16.

As depicted in FIG. 11-18, another convenient option is to drain the sand and/or minerals through another cavity hole 17, which is fixed to one or more attachable perimeter walls 29. This provides the user and users to drain the sand and/or minerals conveniently when multiple sand pit training bags 100 are connected. The cavity hole 17 located on at least one attachable perimeter wall 29 and is covered with a hook and loop releasable fastener 7, and/or cavity cover 21.

When finished with the sand pit 101 the attachable perimeter walls 29 is released from the hook and loop releasable fastener 7; attachable perimeter walls 29 and/or stacked perimeter wall 34 which then be folded to fit inside the sand pit training bag 100 and carried away.

It is to be understood the compressed surface cover 31 can act as the base mineral receiving surface 10 without the sand pit training bag 100 underneath. This will decrease the softness of the enclosure but will allow the user to use the sand pit training bag 100 and sand pit 101 at the same time. For example, the compressed surface cover 31 is directly on to a surface, followed by attaching the attachable perimeter walls 29 and/or stacked perimeter walls 34 around the perimeter of the compressed surface cover 31, attached by at least one hook and loop releasable fastener 7, and/or similar connectors. This can be beneficial for a group setting wherein different exercises stations can be set up, such sand training, and sand bag and/or harness being occupied with one or more users.

It may be convenient to retail the compressed surface cover 31 with the attachable perimeter walls 29 and stacked perimeter walls 34 to be viewed as a separate equipment wherein can be viewed as a sand pit 101.

Examples

Eight sand pit training bags 100 was set up with a compressed surface cover 31 as depicted in FIG. 16 for a 6 foot 5 inches professional football player (not shown) to perform plyometric, speed and agility exercises at 6 inches of sand in the mineral receiving surface 10 with the attachable perimeter walls 29, and a stacked perimeter wall 34 at 18 inches. There was no result of sand leakage around the perimeter of the sand pit 101.

Two sand pit training bags 100 was set up to create an expansion sand pit 101 as depicted in FIG. 13-14 with a total height of sand of 4 inches around the perimeter of the sand pit 101 for a volleyball university varsity athlete. She performed jump serves at a height of 4 feet with forward momentum. There was no result of sand leakage around the perimeter of the sand pit 101.

One sand pit 101 with a height of 4 inches of sand and minerals was set up for a high school athlete to perform vertical jumps from the enclosure of the sand pit 101 with one attachable perimeter wall 29 detached from the sand pit training bag 100 to an elevated box 5 feet away from the sand pit 101. There were no result of sand leakage during the transition from the sand pit 101 to the elevated box.

One sand pit 101 was set up with attachable perimeter walls 29 and stacked perimeter walls 34 as depicted in FIG. 16. Salt and water mixed with bleach (not shown) was added to the sand pit 101, specifically testing for possible damage to the compressed surface cover 31, attachable perimeter walls 29, and stacked perimeter walls 34. After 24 hours, there was no damage to the perimeter walls 29, stacked perimeter walls 34, and compressed surface cover 31.

Figure 18:
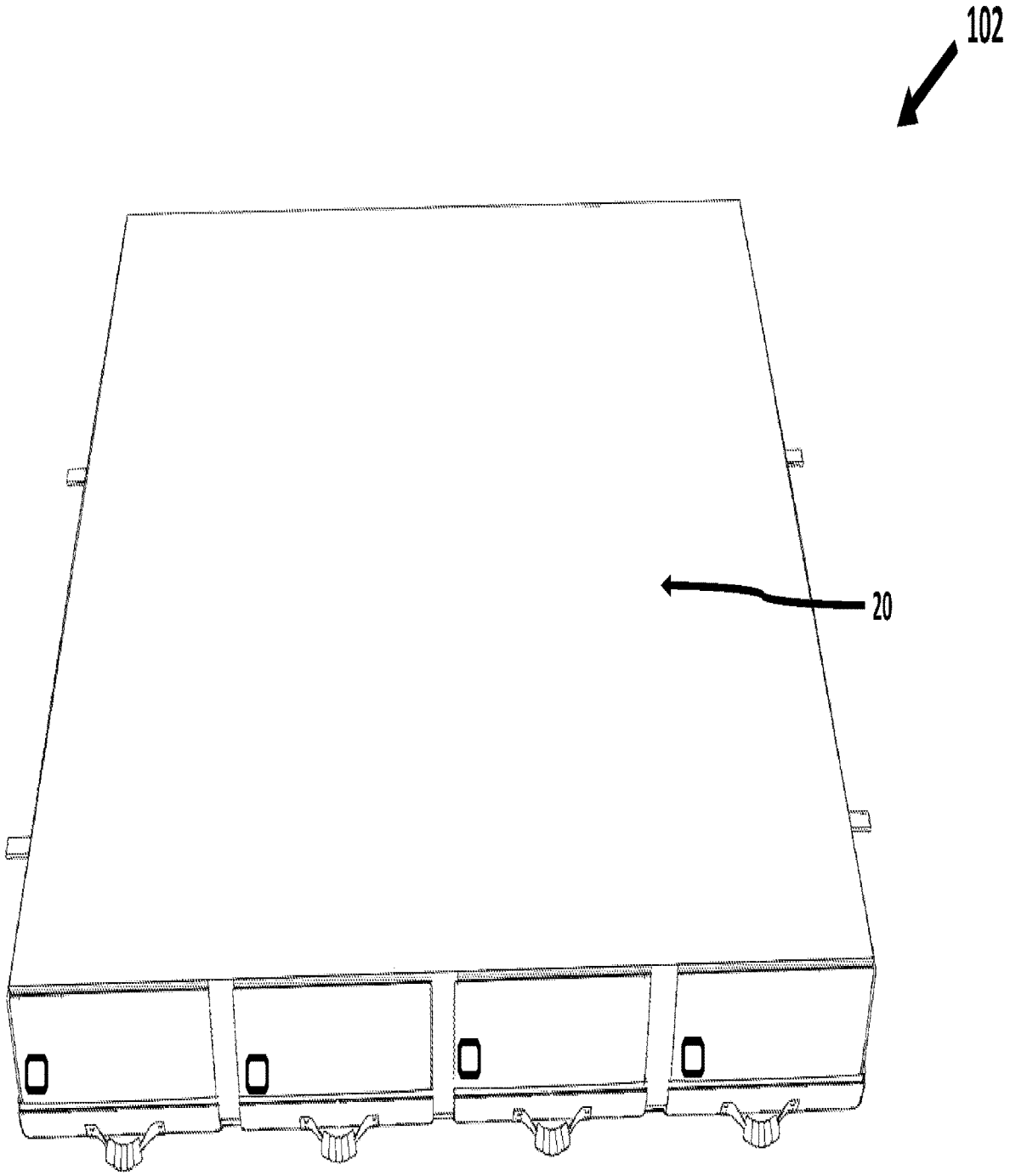
FIG. 18 is a top elevated perspective view of eight attached sand pit training bags with attachable perimeter walls with a top cover in an open configuration, in accordance with an example.
Figure 19:
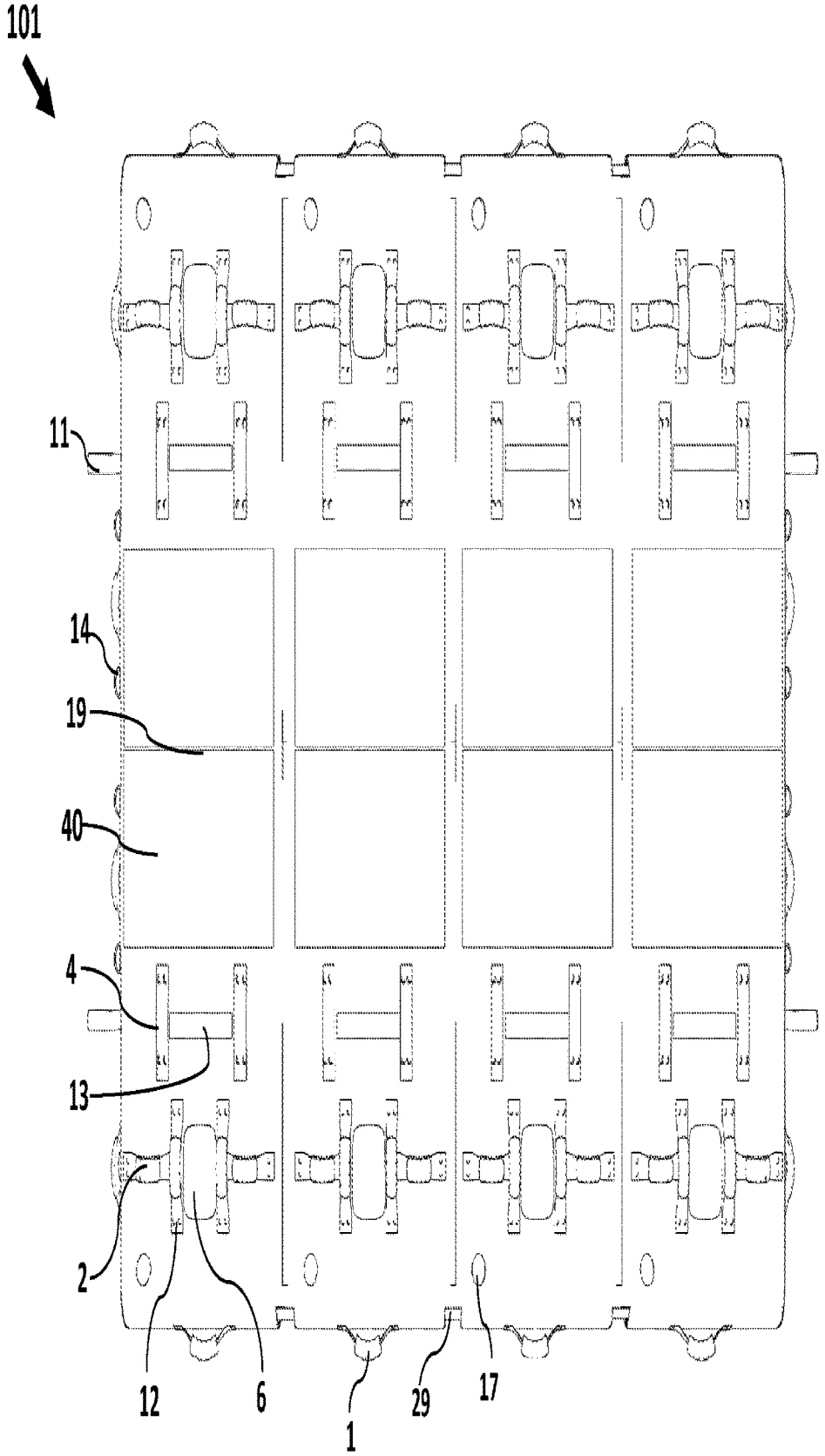
FIG. 19 is bottom perspective view of eight sand pit training bags in an open configuration, in accordance with an example.
Figure 20:
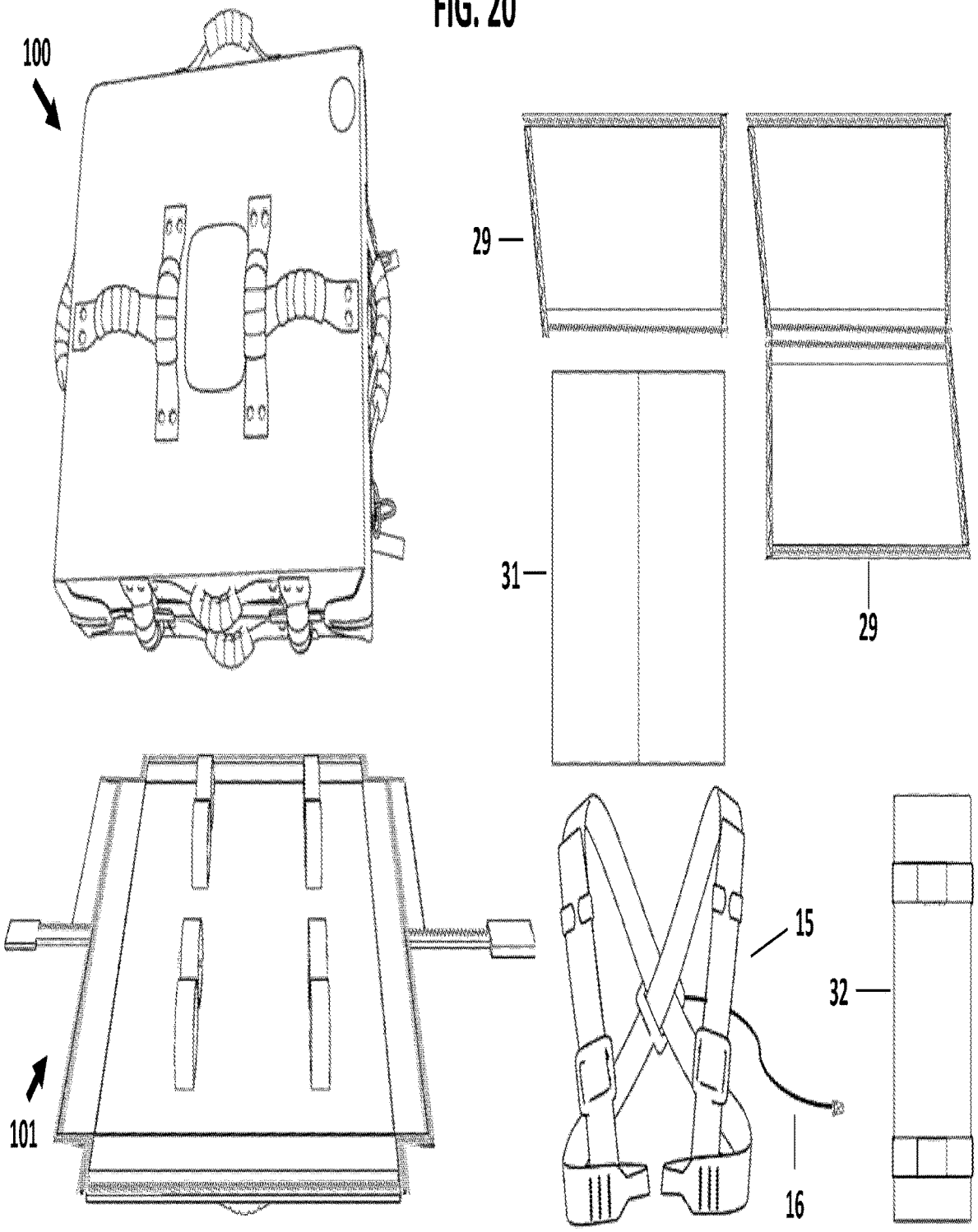
FIG. 20 is a perspective view of a sand pit training bag in a closed bag configuration, attachable wall, compressed surface cover, stacked attachable perimeter wall. sand pit in an open bag configuration, a harness with a connecting strap and a sand filler.

175 pounds of beach sand in the enclosure of eight sand pit training bags 100 connected to form an expansion sand pit 101 with the top cover 20 as depicted in FIG. 18 was left outside for about 48 hours with scattered precipitation throughout the day. There was no result of damage to the exterior of the sand pit training bag 100 and no moisture in the sand pit 101.

In one example of use, a user that stood at a height of 6 feet, 2 inches and possessed experience as military personnel, used the sand pit training bag 100 for a sand bag and dragging sled workout. There were eight sand fillers 32 in the enclosure, with two sand filers 32 in each cooperating hook and loop fasteners 30 with a total of 120 pounds. Accordingly, there were no results of damage in the interior and exterior of the sand pit training bag 100, sand fillers 32, and body harness 15.

In one example, eight sand pit training bags 100 forming an expansion sand pit 101 with attachable perimeter walls 29, stacked perimeter walls 34 and a compressed surface cover 31 as depicted in FIG. 13 was occupied by three college badminton players with a height of 8 inches with moist sand and minerals. After 30 minutes of plyometrics inside the sand pit 101 there was no visibility of sand and minerals outside of the sand pit 101. Also, the three badminton players realized a more convenient, efficient method to drain the sand and minerals from the stacked perimeter walls 34 cavity hole 17.

Additionally, two compressed surface cover 31 was set up with attachable perimeter walls 29 and stacked attachable perimeter walls 34 to be used as a sand pit 101 on a flat surface rear face 18 without the sand pit training bag 100 underneath. There was minimal shifting movement when a single user was performing speed and agility drills with 3 inches of sand around the perimeter of two compressed surface cover 31. To prevent shifting in the sand pit 101, it is recommended to structure the base with the sand pit training bag 100. However, it can be determined to be convenient to use the sand pit 101 without the sand pit training bag 100 underneath if there are more than one users in a group workout, resulting in a functionality of exercises in the sand pit 101 and the sand pit training bag 100 in the same duration.

Sand Fillers

Figure 10:
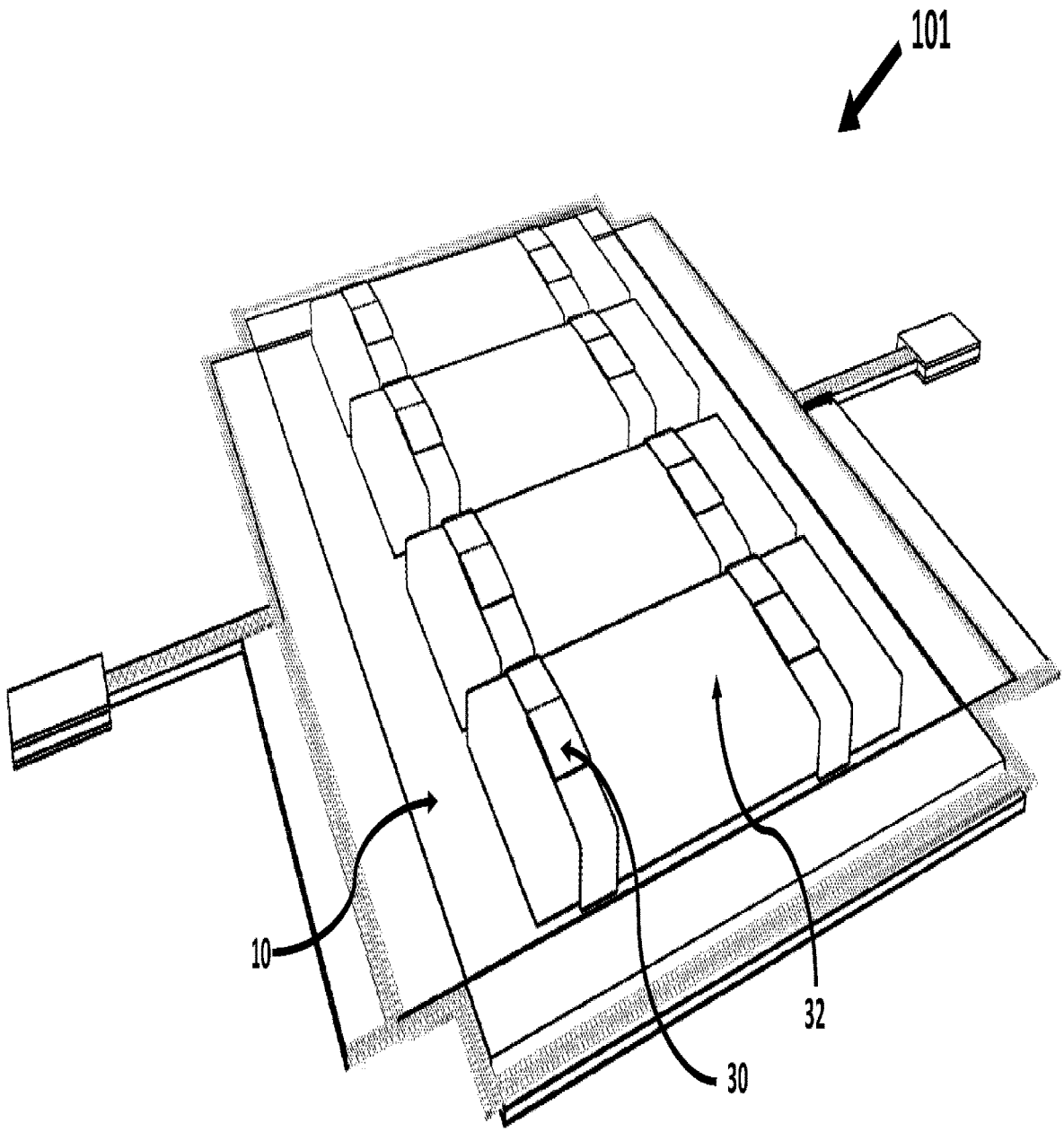
FIG. 10 is a top elevation perspective view of a single sand pit training bag in an open configuration in which four sand fillers have been secured by way of a securing device attached to the sand training bag, in accordance with an example.

FIG. 10 illustrates four sand fillers 32 being secured by four cooperating hook and loop fasteners 30 in the enclosure of the sand pit training bag 100 in an open configuration. The sand fillers 32 can be supplied with sand and/or minerals, or a user can be required to fill the sand fillers 32 themselves. The sand fillers 32 can be designed to allow sand to be neatly contained when not needed, such as to not mix loosely with other contents of the sand pit training bag 100. The sand fillers 32 can also be designed to allow the sand to be poured onto a mineral receiving training surface 10 provided by the sand pit training bag 100 in an open configuration, such as onto mineral receiving training surface 10 of the sand pit 101 configuration, to form a mineral receiving training surface 10. The sand fillers 32 fabrics in some embodiments is a mixture nylon and/or polyester and/or canvas with a coating of polyvinyl chloride and/or polyurethane to hold more than 10 pounds for durability and transparent proof.

FIG. 10 illustrates the sand fillers 32 fastened to the sand pit training bag 100, to allow a user to secure the sand fillers 32 inside the sand pit training bag 100 when using the sand pit training bag 100 as a weight, in a closed configuration. For example, the sand pit training bag 100 and sand fillers 32 can include one or more cooperating hook-and-loop fastener 30 components to allow the sand fillers 32 to be secured to an interior surface of the sand pit training bag 100.

In some embodiments, the sand fillers 32 are not secured to the cooperating hook and loop fastener 30 wherein can be moved freely in a closed configuration.

In some embodiments, the sand fillers 32 can be formed of semi-ridged material forming rectangular shapes to allow the pouches to be more easily stacked on top of each other and/or bi laterally within the sand pit training bag 100 for optimized storage and to allow a user to maximize the weight of the sand pit training bag 100 when used as a weight. Although in other embodiments the sand fillers 32 can be made of a flexible material and can still be able to be stacked on top of each other and/or bilaterally.

Although the aforementioned range is considered the preferred embodiment, the size of the sand fillers 32 can comprise of an endless amount of sizes and ranges, that are suitable to serve the purpose of this disclosure. The sand fillers 32 can be as large, or as small as needed to serve the intended purpose In some embodiments the sand fillers 32 are closed using hook and loop releasable fasteners 7, and in some embodiments the sand fillers 32 include a grip or other gripping surface to be used in lifting them in and out of the sand pit training bag 100. Also, this can be an addition for exercises such as, bicep curls, shoulder flexion, extension, substitution of a kettlebell swing, to name a few.

In some embodiments, one or more grip can be made from seat belt webbing on each side of the sand filler 32. Hook and loop releasable fasteners 7 can be found on the top to open and close the sand fillers 32. The lining underneath the hook and loop releasable fastener 7 can be made of a mixture of nylon and/or lining.

In some embodiments, one or more sand filler 32 can have an optional logo 6 and stating how many pounds each sand fillers 32 can hold. It may be convenient to retail the pouches in a number of standard sizes designed to hold predetermined weights, resulting in different logo numbered of pounds.

Body Harness and Backpack Strap

The sand pit training bag 100 can be provided with a body harness 15 when retailed. As depicted in FIG. 6, the body harness 15 with the joining strap 16 is used as an assisted conditioning tool for the user while walking, jogging, running, sprinting and all other forms of acceleration. The joining strap 16 is attached to at least one loop 14 on the body harness 15 and then connecting to one or more loops 14 located around the perimeter of the sand pit training bag 100. When finished the task, the user can detach the joining strap 16 from the loop 14 and place the body harness 15 and joining strap 16 inside the sand pit training bag 100 to be carried away. The use of the one or more loops 14 around the perimeter of the body harness 15, is to be easily attached and detached, although other attachment mechanisms could be used as well.

In some embodiments, the sand pit training bag 100 includes anchor points for use in securing the body harness 15 and/or joining strap 16 as depicted in FIG. 6.

Figure 5:
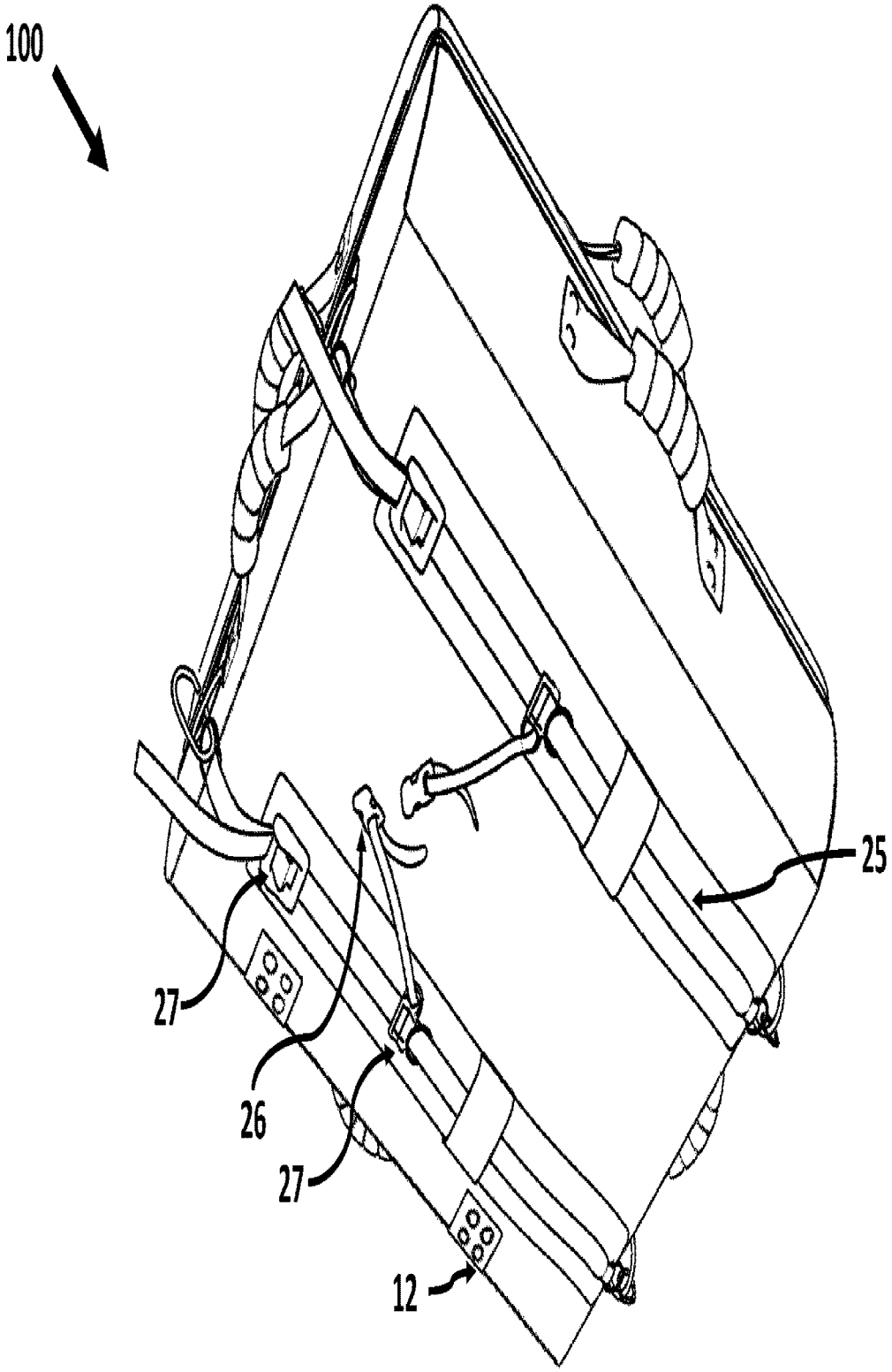
FIG. 5 is a bottom elevation perspective view of the sand pit training bag in a closed configuration with one or more backpack straps attached to the loops, in accordance with an example.

FIGS. 1 and 5 illustrates the loops 14 in usage of shoulder strap 28 and two backpack straps 25, which can also be used as a weighted vest.

FIG. 6 illustrates a body harness 15 to allow the user to use the sand pit training bag 100 as resistance tool. The body harness 15 can include one or more releasable buckles 26 and a strap adjuster 27 of at least 8 inches. This will serve as a faster way to put on and release the body harness 15 during a walking, running or sprinting position, working on V02 max, also a drop set when working on strength training. At least one buckle 26 and one strap adjuster 27 can be placed at least 1 inch below the starting of the padding and an additional buckle 26 and working strap 33 can be placed at least 1 inch below, allowing the user to adjust to their right body size.

For a rear weight vest and/or to be worn as a backpack, the user has an option to attach at least one straps, acting as a backpack strap 25 to the sand pit training bag 100, with at least one loop 14 to the sand pit training bag 100, allowing the user to adjust the appropriate size when walking, running or sprinting and/or to be used as a daily bag. The user also has the option to carry the sand pit training bag 100 by hand, such as carrying the bag as a duffle bag.

If the user intends to use the sand pit training bag 100 with the body harness 15 and backpack strap 25, shoulder strap 28 attached to the sand training bag 100 in a closed configuration as a dragged resistance, the external surface of one side of the sand pit training bag 100 may be flat with a durable surface such as dense rubber and/or other dense materials, preventing damage to the exterior of the sand pit training bag 100 when being dragged or slammed on many surfaces.

Use

Embodiments of the sand pit training bag 100 of the present description can be beneficial for physical training facilities, physical rehabilitation clinic and/or outdoor settings. Many training facilities and rehabilitation centers around the globe does not incorporate sand training in either training or rehabilitation programs and treatment. With positive evidence —based research of sand training, the provision of the portable, effective, and multi-use sand training bag of embodiments of the present invention may greatly expand the potential of sand training.

The sand pit training bag 100 in a closed configuration can be viewed as a general exercise training bag with at least one grip around the perimeter to grasp and use for multiple exercises such as, tricep extension, bicep curls, front squats, back squats, walking lunges, plank pulls, not limiting to other physical exercises.

The user of sand pit training bag 100 can hold the sand pit training bag 100 from one or more grips 1-4 around the sand pit training bag 100 for any desired grip, and may adjust the weight of the sand pit training bag 100 by adding or removing content such as sand fillers 32.

When the user would use the sand pit training bag 100 as an isolated tool, such as a pulling exercises as depicted in FIG. 6, the sand fillers 32 can be held in one or more cooperating hook and loop fastener 30 to prevent swivel when dragging the sand pit training bag 100. To work on core stability, a recommendation will state to release the sand fillers 32 and/or other weighted objects from the cooperating hook and loop fastener 30 as core stability involves the body to control the position and movement, such as sand fillers 32 in the enclosure of the sand pit training bag 100.

In some embodiments, the dimensions and other characteristics such as weight of the sand pit training bag 100 and sand pit 101 can be chosen to allow it to be transported around by one user or, in some embodiments, by more than one user. The sand pit training bag 100 can be closed into a bag configuration to provide a convenient look and function illustrated in FIGS. 1-5, such as to be easily carried onto a plane, bus or other vehicle, with or without any sand fillers 32.

Many athletes seek out a local beach or other sand training location for sand training. The sand pit training bag 100 of the present description can be used for speed, strength and rehabilitation training, both in many of the ways a natural sand and/or mineral surface can be used and in other ways herein described. The sand pit training bag 100 of the present description can also be provided in association with an in-depth training program and a set of physical rehabilitation guidelines, such as for use as a kit or program for rehabilitation.

In some embodiments, the sand fillers 32 are held closed via a hook-and-loop fastener 7, and can be conveniently unfolded from the hook-and-loop fastener 7 to discharge a contained quantity of sand and minerals, such as ten pounds of sand, into the mineral receiving surface 10 when the sand pit training bag 100 has been opening for use as a sand pit 101. When the activity is completed, the user can use one or more cavity hole 17 by releasing the hook and loop releasable fastener 7 and cavity cover 21 from both ends of the attached perimeter wall 29 and/or underneath of the sand pit training bag 100, pouring the quantity of sand and minerals into each sand fillers 32. The sand fillers 32 can be stacked on one another bi-literally or secured by at least one cooperating hook and loop fastener 30 for easy storage in the sand pit training bag 100, such as for transport when the bag is in a closed configuration.

In other embodiments, sand fillers 32 may not be provided, or sand fillers 32 may have other configurations or elements. It is to be understood in some embodiments, the cavity hole 17 is not provided and a user scoops or pours out sand from the bag through the top opening of the sand pit 101.

It is to be understood the user has an option to leave the sand and/or minerals in the enclosure without the use of the sand fillers 32. The durability of the hook and loop releasable fastener 7 and/or other fasteners with the coating of polyvinyl chloride and/or polyurethane, the sand and/or minerals are secure without any possible leakage when carrying the sand pit training bag 100 in a closed configuration. This is convenient for a user that will be using the sand pit 101 frequent in multiple locations.

In some embodiments, the program will present and be based on evidence-based programs and results, such as based on programs developed by fitness and medical professionals.

There are many minerals that can assist the human body for inflammation, such as salt and water. With the polyvinyl chloride and/or polyurethane waterproof coating, the user has options to use salt and water, not limiting to similar minerals with no damage to the enclosure fabrics.

The sand pit training bag 100 and sand pit 101 is not only made for athletes, but can also be used by the general population. Science-based research indicates sand training is more effective for VO2 max training compared to other surfaces. Also, sand and/or mineral training reduces the risk of injury, as sand and minerals are a low impact surface.

In some embodiments, the sand pit training bag 100 can provide users with a more effective workout in a shorter amount of time. The provision of sand and/or mineral draining structure in some embodiments also assists in making the sand pit training bag 100 suitable for use in an indoor setting. For example, sand and/or minerals can be neatly contained in the sand pit 101, and in some embodiments can be drained from the sand training bag 100 from the cavity hole 17 when training tasks have been completed and the user is ready to pack up the sand pit training bag 100.

It is to be understood the sand pit 101 can be used for cleansing of the limbs with salt and water to children sand and mineral leisure related activities.

At least one cooperating hook and loop releasable fastener 30 can be provided in the enclosure of the sand pit training bag 100. This allows the user to secure valuable objects such as laptops with minimal to no shifting when transporting.

At least one compartment around the perimeter of the sand pit training bag 100 in a closed and open configuration. The compartment may be made of nylon with at least one hook and loop fastener 7 to secure the objects. This allows the user to keep objects such as coins in a smaller compartment and joining strap 16 in a longer compartment.

In some embodiments, a sand pit training bag 100 is designed to be used with other sand pit training bags 100 to form an extended sand training surface. An extended mineral receiving surface 10 can be useful particularly for activities which require more space than can be provided by a single sand pit training bag 100.

Figure 12:
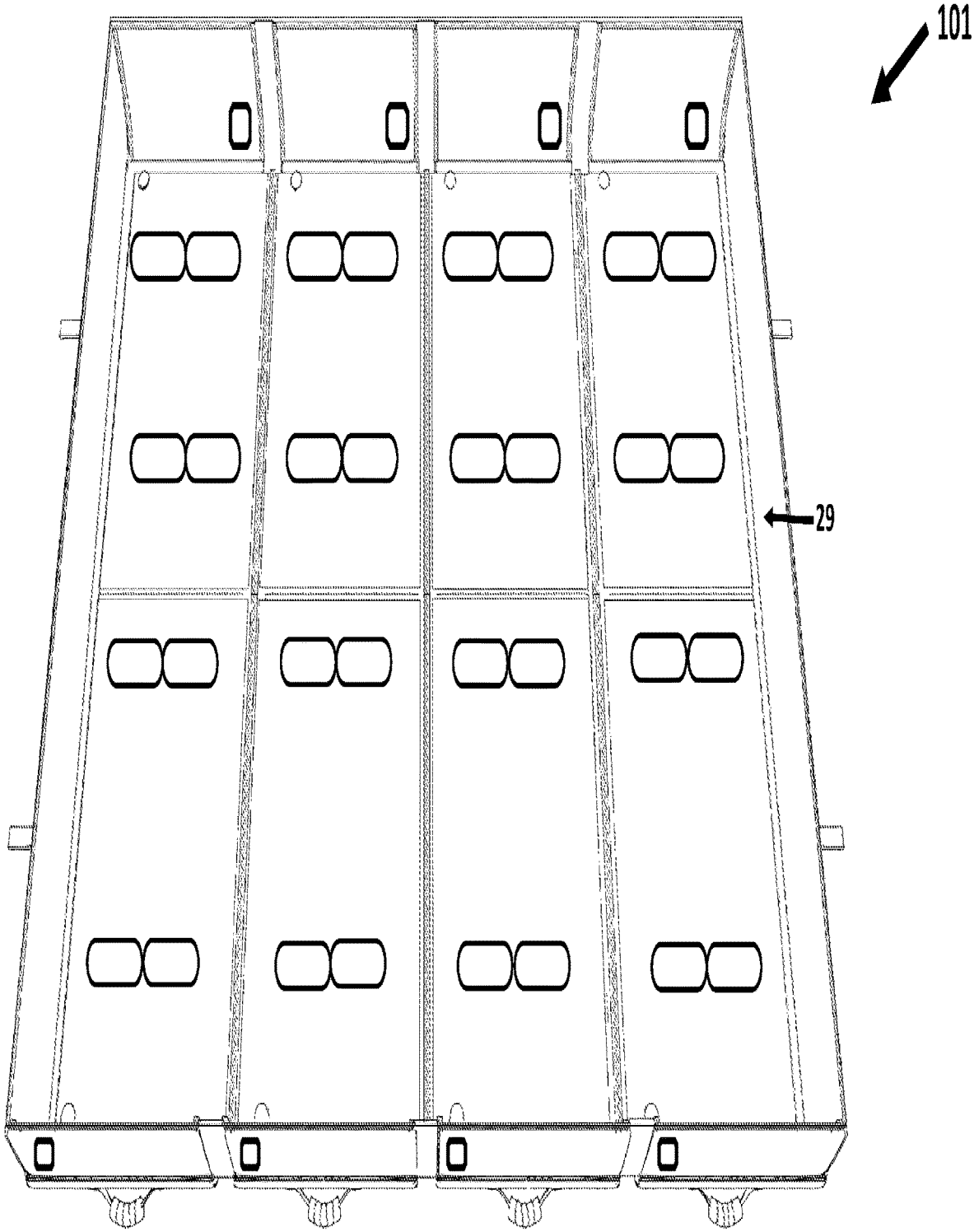
FIG. 12 is a top elevated perspective view of eight attached sand pit training bags with attachable perimeter walls sizing for eight sand pit training bags in an open configuration, in accordance with an example.

In some embodiments two or more sand pit training bags 100 can be joined together to form an extended mineral receiving surface 10, such as FIG. 12-13 is shown up to eight sand training bags 100 joined together, each sand pit training bag 100 forming a part of an outside perimeter wall of a sand pit 101.

In some embodiments the sand pit training bags 100 does not form a part of an outside perimeter wall of a sand pit 101 when joined together, creating options for the user to run in and out of the sand pit 101 without jumping over the attachable perimeter wall 29.

In some embodiments, sand pit training bags 100 include features to be used in joining the sand pit training bag 100 to other sand pit training bags 100.

In some embodiments, sand pit training bags 100 includes removable components and/or features, such as attachable perimeter wall 29 sections, to enable reconfiguration of the sand pit training bags 100 with other sand pit training bags 100 in forming an extended mineral receiving surface 10.

Figure 11:
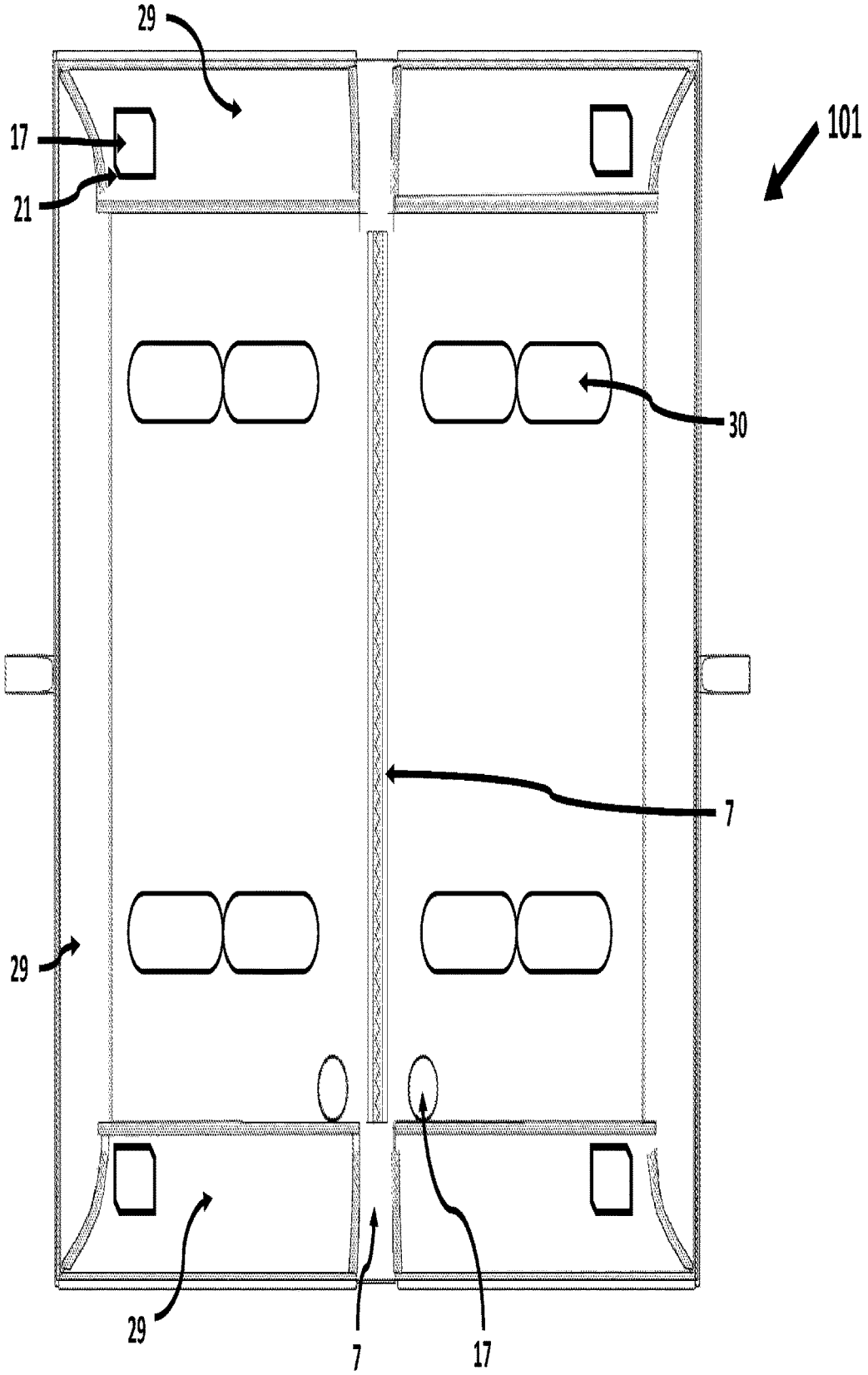
FIG. 11 is a top perspective view of two attached sand pit training bags with attachable perimeter walls, sizing for two sand pit training bags in an open configuration, in accordance with an example.

An embodiment of a sand pit training bag 100 for use as a module of an extended mineral receiving surface 10 is shown in FIGS. 13-14 and 16. Two joined sand pit training bags 100 forming a first extended mineral receiving surface 10 are shown in FIG. 11, 14, 16 with a top cover 20 shown on FIG. 18.

In some embodiments, the top cover 20 is attached via hook and loop releasable fastener 7 to keep the sand and/or minerals in a closed configuration when not in use. For example, if the sand pit is left outside, the user an option to attach the top cover 20 to prevent any additional minerals not intended for the sand pit 101. Also, sport team setting, such as baseball, the sand pit can fixed outside for sand and/or mineral training while the top cover 20 can prevent any liquids from entering the sand pit 101.

Figure 17:
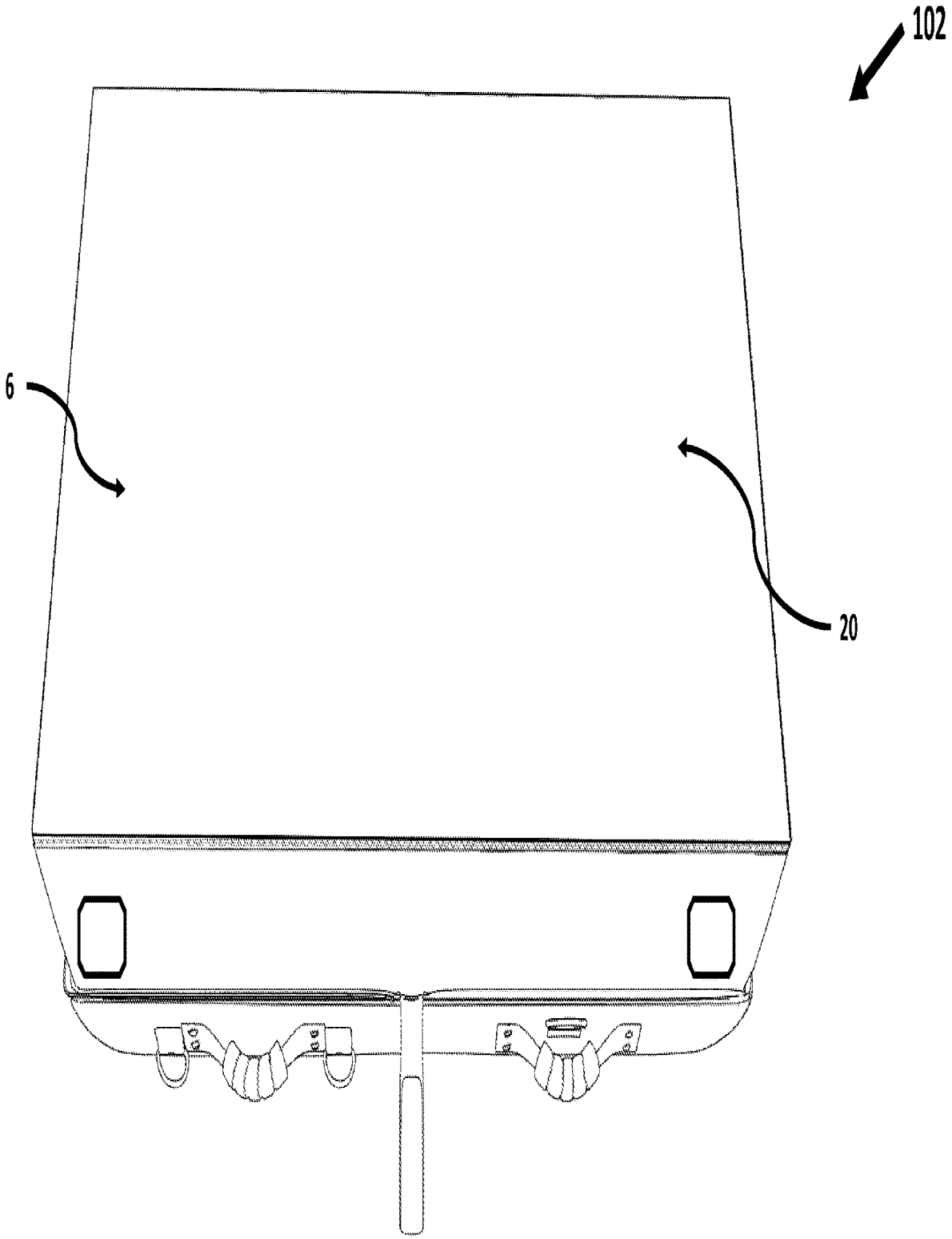
FIG. 17 is a top elevated perspective view of two attached sand pit training bags with attachable perimeter walls and a top cover in an open configuration, in accordance with an example.

As depicted in FIG. 17-18, a top cover 20 around the perimeter of the sand pit 101 of at least two sand pit training bags 100 which is attached via hook and loop releasable fastener 7 with the design and fabric as the attachable perimeter wall 29.

Eight joined sand pit training bags 100 forming a second extended mineral receiving surface 10 with a top cover 20 are shown in FIG. 18.

To permit a plurality of sand pit training bags 100 to be joined, in some embodiments one or more parts of the wall structure of a sand pit training bag 100 can be removable from the sand pit training bag 100 so that the mineral receiving surface 10 can be moved adjacent one or more mineral receiving surface 10 of one or more other sand pit training bags 100 to form an extended mineral receiving surface 10 which is not broken by any vertical wall segments.

In some embodiments, an extended mineral receiving surface 10 can also include other joining components to join mineral receiving surface 10 together. Segments of the wall structure of a sand pit training bag 100 can be held together by way of hook and loop releasable fasteners 7 so that sections of wall structure to be removed from the wall structure or joined to other wall structures, such as the wall structures of other sand pit training bags 100. Additionally, the hook and loop fasteners 7 can also be configured to be structured with a cavity hole 17 and a cavity cover 21 to cover said cavity hole 17.

In some embodiments, a sand pit training bag 100 is essentially a set of modular wall portions which can be joined together to form a sand pit training bag 100 or reconfigured to form a single-bag sand pit 101 or reconfigured to form a multi-bag sand pit 101.

In some embodiments, one or more perimeter attachable wall 29 sections of a wall structure are detachable, held to one another via releasable fasteners 7. However, in some embodiments, at least one set of wall sections are not detachable, but form a core or foundational part of the wall structure of a sand pit training bag 100.

In the sand pit training bags 100 depicted in FIGS. 11-16, a sand pit training bag 100 wall structure includes at least one set of hook and loop releasable fasteners 7, which are provided between various wall segments to hold the wall segments together in forming various sand pit training bag 100 configurations and/or sand pit 101 configurations. For example, FIG. 11 illustrates a releasable fastener 7 joins two attachable perimeter wall 29 segments together to from a corner of an attachable perimeter wall 29 of an extended mineral receiving surface 10. The hook and loop releasable fastener 7 of a corner is approximately 5 to 10 centimeters in length, although other sizes can be appropriate in other embodiments and the length depends on the height of the corresponding attachable perimeter wall 29 and/or stacked perimeter wall 34. Although the aforementioned range is considered the preferred embodiment, the size of the sand pit 101 attachable perimeter walls 29 and hook and loop releasable fastener 7 can comprise of an endless amount of sizes and ranges, that are suitable to serve the purpose of this disclosure. The sand pit 101 attachable perimeter walls 29 and hook and loop releasable fastener 7 can be as large, or as small as needed to serve the intended purpose. Examples of hook and loop releasable fasteners 7 includes zippers, although other materials can be appropriate in other embodiments. A hook and loop releasable fastener 7 is provided in the corners to allow sections of the attachable perimeter wall 29 to be removed, such as so that the reminder of the perimeter wall can be joined to another attachable perimeter wall 29 of one or more additional sand pit training bags 100. Additionally, to increase the height of the sand pit 101 a stacked perimeter wall 34 can be attached via hook and loop releasable fastener 7 in one or more sand pit training bag 100 as depicted in FIG. 16. Corner hook and loop releasable fasteners 7 allow vertical wall segments to be folded flat or, in cooperation with other releasable fasteners 7, allow vertical wall segments to be removed.

In some embodiments, vertical wall segments are simply laid flat or folded on top and/or under mineral receiving surface 10 when an extended mineral receiving surface 10 is formed, rather than being removed entirely.

In some embodiments, an attachable perimeter wall 29 is used to join a part of a perimeter wall of one sand pit training bag 100 to a part of an attachable perimeter wall 29 of another sand pit training bag 100. An attachable wall 29 can be provided to a user in a variety of ways, such as being provided with each sand pit training bag 100 as a detachable modular part of the sand pit training bag 100, being included in each sand pit training bag 100 as a stowed-away portion of wall structure which is stored in a pouch or under a cover when not in use and/or being provided as part of a kit including more than one sand pit training bag 100. At least one attachable perimeter wall 29 is provided to span the distance between a segments of the attachable perimeter wall 29 of one sand pit training bag 100 and a segment of the attachable perimeter wall 29 of another sand pit training bag 100 when the two segments do not extend out far enough to be joined directly. Attachable perimeter wall 29 can be joined to wall segments by way of releasable fasteners 7 such as zippers or hook-and-loop fasteners 7. This provides the user to create a dense segment surface to connect to sand pit training bags 100 to form an expansion sand pit 101.

As a user of an extended mineral receiving surface 10 may not have enough sand and/or minerals to cover the perimeter of the sand pit 101 when formed an extended surface, the mineral receiving surface 10 of each modular sand pit training bag 100 is made from vinyl, polyester or similar low impact material for walking, running, sprinting, jumping or similar active movements.

The compressed surface cover 31 can be sized to fit over the wall segment wherein connects the two sand pits 101 together (not shown).

It is to be understood the wall segment can be used with or without the compressed surface cover 31.

Expanded mineral receiving surface 10 will be beneficial for individuals, in an indoor and outdoor settings which call for a substantial amount of space for sand pit training 100. As an example, beach volleyball players can use an expanded mineral receiving surface 10 for a recreational and/or training game of beach volleyball.

In addition to the volleyball team setting, the attachable perimeter walls 29 can stack on top of each other with a stacked perimeter wall 34 via hook and loop releasable fastener 7 which can also have a cavity hole 17, cavity cover 21 as depicted in FIG. 11-18.

This is beneficial a team setting, such as a beach volleyball team and any user desired to have a larger amount of sand and/or minerals in the sand pit 101 as shown in FIG. 13.

It is to be understood the stacked perimeter walls 34 may be retailed as a kit or sold separately, depending on the user's desires. Also, each cavity hole 17 on the attachable perimeter wall 29 and stacked perimeter wall 34 does not need to be used. Even if multiple sand pit training bags 100 are provided as a kit, each may include a cavity hole 17.

In some embodiments so that each sand pit training bag 100 can be used independently at the discretion of the user.

It is to be understood the attachable perimeter walls 29 can be reconfigured by a user to suit their needs due to the hook and loop releasable fasteners 7 provided between sections of the attachable perimeter walls 29. For example, if a user desires to use the sand pit 101 as an unstable surface for a plyometric jump or similar active movement, the user can remove a section of attachable perimeter wall 29 from one edge of the sand pit 101 such that the mineral receiving surface 10 is bounded only on three sides or only at substantial height along three sides, such as to allow easier use of the mineral receiving surface 10 for low inch plyometric or similar active movements, as described in examples. The receiving surface can be bounded by one or more of downward facing bounding flaps 8, bounding flaps facing upward 9, and bottom flaps 11.

In some embodiments, one or more cavity holes 17 are provided to permit the release of sand and/or minerals when exercises in the sand pit 101 are completed. The cavity hole 17 can be rimmed in metal, copper and/or steel. The cavity hole 17 is secured by stitching, gluing and/or a cement lining around the circumference of the cavity hole 17. Although the aforementioned range is considered the preferred embodiment, the size of the cavity hole 17 and surface cover 21 can comprise of an endless amount of sizes and ranges, that are suitable to serve the purpose of this disclosure. The cavity hole 17 and surface cover 21 can be as large, or as small as needed to serve the intended purpose. The cavity hole 17 is covered by a surface cover 21, surface cover 21 is made from polyvinyl chloride covered by liquid proof material, although other materials can be used in other embodiments provided the cover is able to impede the flow of sand out of the cavity hole 17 when covering the cavity hole 17.

In some embodiments, the sand pit training bag 100 includes snaps and/or other fasteners to hold the compressed surface cover 31 over the cavity cover 21.

In some embodiments, a sand pit training bag 100 is a multi—purpose piece of training equipment, for a number of exercises. The sand pit training bag 100 can be designed to support 50-100 pounds of sand and/or minerals, depending on the selected size by the user and the materials used, and a combination of sand pit training bags 100 can be designed to support a further weight of sand and/or minerals.

FIG. 13-14 illustrates a compressed surface cover 31 to hold sand and/or minerals rather than requiring a user to pour sand into a sand pit 101 and then remove the sand from the interior of the sand pit training bag 100 when complete. For example, the sand pit training bag 100 can include a sub compartment into which the sand and/or minerals can be moved once training exercises is complete, which can be closed to hold the sand and/or minerals from being loosely deposed within the interior of the sand pit training bag 100.

In some embodiments, the mineral receiving surface 10 can be overlaid with a cover or liner (not shown) provided to contain sand deposited on the mineral receiving surface 10, and a user may be able to fold up the cover or liner with the sand and/or minerals contained when they have finished their exercises.

In some embodiments the mineral receiving surface 10 cover or liner can be secured to the mineral receiving surface 10 or other internal surface of the sand pit training bag 100 such as at least one hook and loop releasable fastener 7, adhesive, and/or stitching, such as to allow the cover to form a sub compartment or pouch within the sand pit training bag 100 when not deployed, while in some embodiments the mineral receiving surface 10 cover or liner can be loosely deposited over the mineral receiving surface 10 such that a user may remove it from the sand pit training bag 100 to shake out sand or to store separately.

Figure 7:
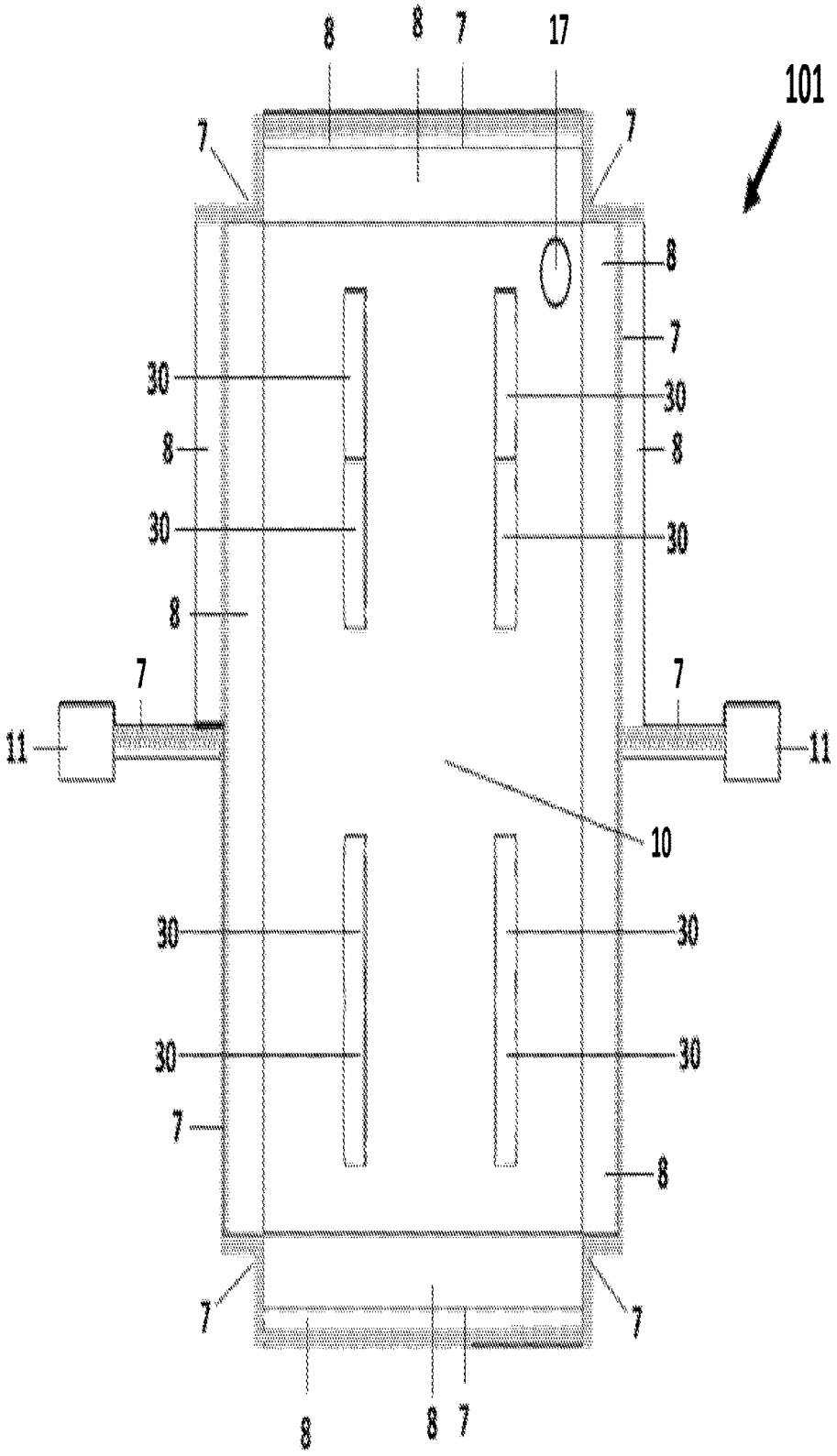
FIG. 7 is a top perspective view a single sand pit training bag in an open configuration, in accordance with an example.
Figure 8:
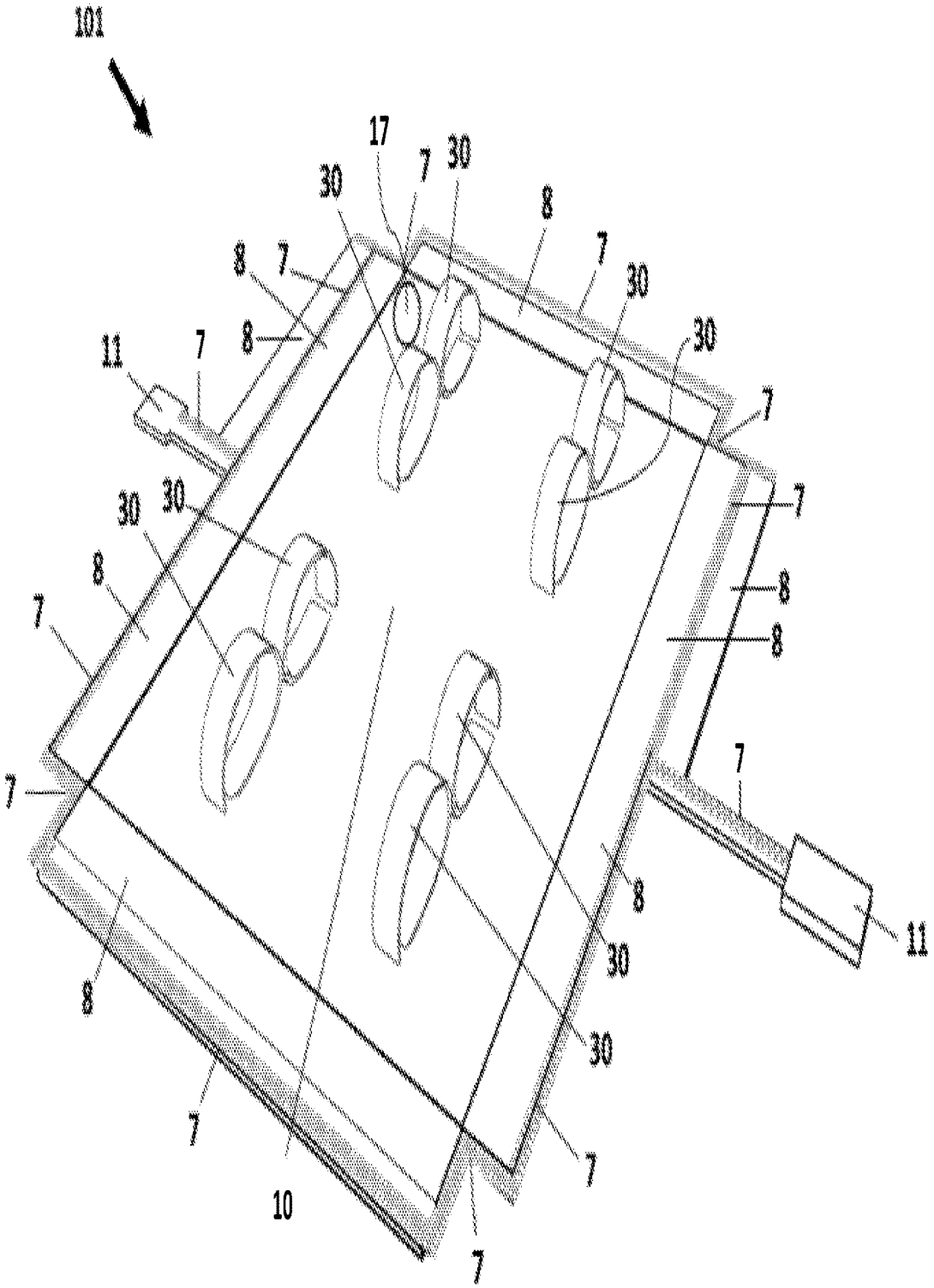
FIG. 8 is a side perspective view of a single sand pit training bag in an open configuration, in accordance with an example.
Figure 9:
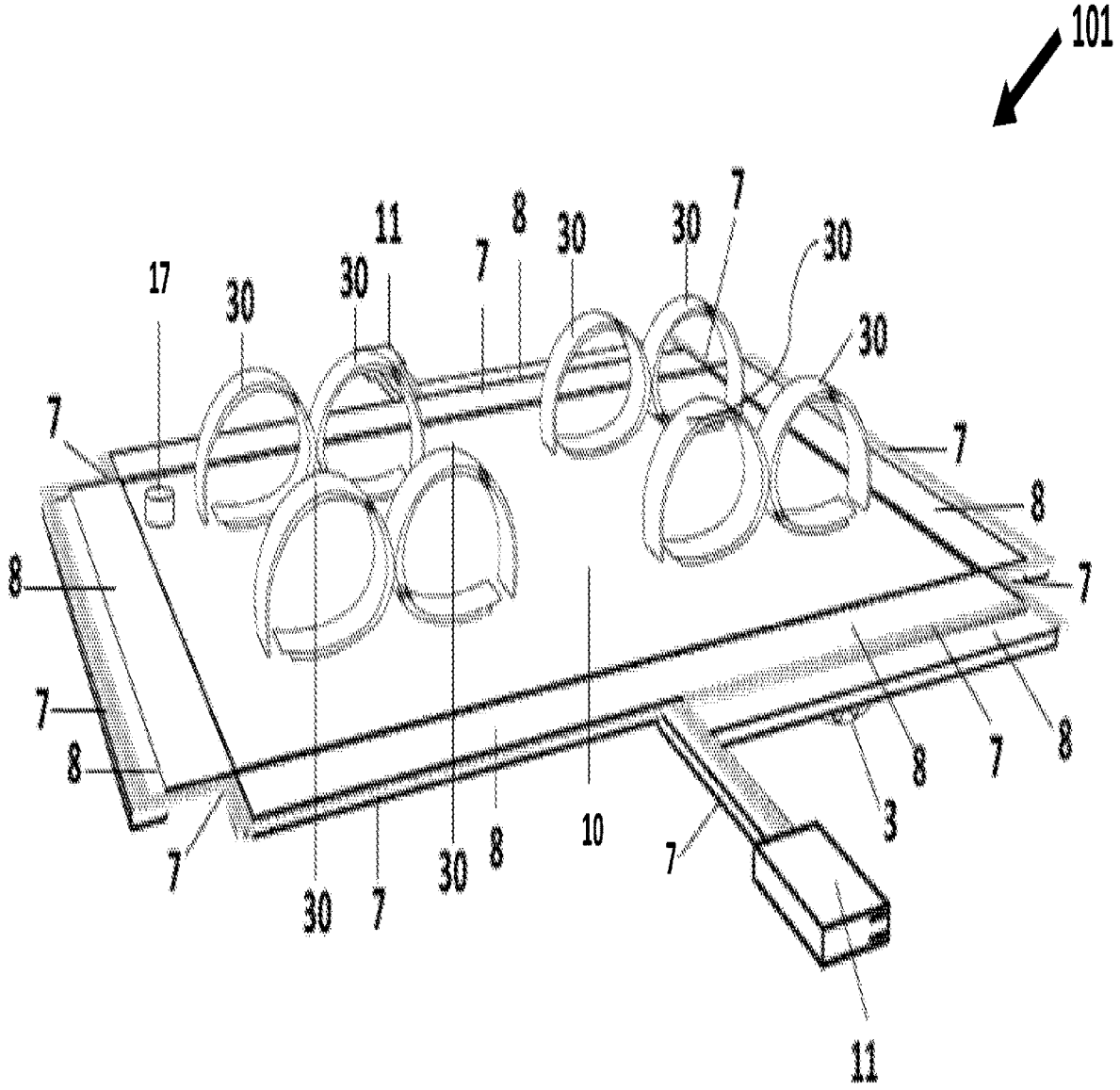
FIG. 9 is a top elevation perspective view of a single sand pit training bag in an open configuration, in accordance with an example.

In some embodiments, a sand pit training bag 100 can have one or more cooperating hook and loop fasteners 30 to hold sand fillers 32. Each strap is provided with a fixed reinforcement and/or similar fabric in between the interior and exterior fabrics. FIG. 7-9 depicts an example sand pit training bag 100, which includes four pairs of straps, each strap secured to an internal surface of the sand pit training bag 100. Each pair of straps as depicted in FIG. 10 is used to hold sand fillers 32 and/or similar objects, with each strap held is a position wrapped around the sand filler 32 via hook and loop releasable fastener 7 components.

It is to be understood different sizes of a sand pit training bag 100 can be retailed wherein could be manufactured without cooperating hook and loop fasteners 30 and in some instances, more than one cooperating hook and loop fasteners 30 can be manufactured.

In some embodiments, a cavity hole 17 is not provided, such as embodiments in which sand does not need to be poured out of the pit.

As depicted in FIG. 11-18 at least one cavity hole 17, hook and loop releasable fastener 7 and cavity cover hole fixed on the attachable perimeter wall 29.

It is to be understood that while the sand pit training bag 100 has been depicted as a rectangular bag when in a closed configuration, providing a substantially flat mineral receiving surface 10, in other embodiments the sand pit training bag 100 can be less structured.

It should be noted that the accompanying figures are intended to present illustrations of exemplary embodiments of the present disclosure. These figures are not intended to limit the scope of the present disclosure. It should also be noted that accompanying figures are not necessarily drawn to scale.

The foregoing descriptions of specific embodiments of the present technology have been presented for purposes of illustration and description. They are not intended to be exhaustive or to limit the present technology to the precise forms disclosed, and obviously many modifications and variations are possible in light of the above teachings. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

It is envisioned that other styles and configurations can be easily incorporated into the teachings of the present disclosure and only one particular configuration has been shown and described for purposes of clarity and disclosure and not by way of limitation of scope.

It is to be understood that the present invention is not limited to the embodiments described above, but encompasses any and all embodiments within the scope of the following claims.

What is claimed is:

1. A sand pit training bag transitionable between a closed bag configuration and an open bag configuration comprising:

a top flap, a bottom flap, and two side flaps, wherein each flap comprises a hook and loop fastener, wherein when the sand pit training bag is in the closed bag configuration, the hook and loop fasteners of the top and bottom flaps are engaged with each other and the hook and loop fasteners of the two side flaps are engaged with each other, and wherein when the sand pit training bag is in the open configuration, the hook and loop fasteners of the top and bottom flaps are not engaged with each other and the hook and loop fasteners of the side flaps are not engaged with each other;

at least one cooperating hook and loop fastener, wherein the cooperating hook and loop fastener is secured in the sand pit training bag in the open bag configuration;

one or more sets of grips, wherein one grip in the one or more sets of grips is positioned on the periphery of the external surface of the sand pit training bag in the closed bag configuration;

one or more sets of loops, wherein at least one loop in the one or more sets of loops is configured to be secured to the periphery of the external surface of the sand pit training bag in the closed bag configuration;

one or more attachable accessories; and a set of one or more weights, wherein at least one weight is a sand filler, and wherein the external surface of the sand pit training bag comprises a layer of a fixed flat durable surface comprising nylon.

2. The sand pit training bag according to claim 1, wherein the cooperating hook and loop fastener is located in the sand pit training bag in the open bag configuration to secure objects.

3. The sand pit training bag according to claim 1, wherein the one grip of the one or more sets of grips is constructed with seat belt webbing positioned on the periphery of the external surface of the sand pit training bag in the closed bag configuration.

4. The sand pit training bag according to claim 1, wherein the layer of the fixed flat durable surface is configured for preventing damage to the exterior of the sand pit training bag when being dragged or slammed.

5. The sand pit training bag according to claim 1, wherein the at least one loop of the one or more sets of loops is configured to be secured to the periphery of the external surface of the sand pit training bag in the closed bag configuration for attaching accessories.

6. The sand pit training bag according to claim 1, wherein the at least one weight of the set of one or more weights comprises a grip secured on the external surface.

* * * * *